US008264507B2

(12) United States Patent
Hudson et al.

(10) Patent No.: US 8,264,507 B2
(45) Date of Patent: Sep. 11, 2012

(54) GRAY SCALE DRIVE SEQUENCES FOR PULSE WIDTH MODULATED DISPLAYS

(75) Inventors: Edwin Lyle Hudson, Los Gatos, CA (US); David John Cowl, Santa Clara, CA (US)

(73) Assignee: Jasper Display Corporation, Hsinchu (TW)

( * ) Notice: Subject to any disclaimer, the term of this patent is extended or adjusted under 35 U.S.C. 154(b) by 0 days.

(21) Appl. No.: 13/340,100

(22) Filed: Dec. 29, 2011

(65) Prior Publication Data

US 2012/0162293 A1 Jun. 28, 2012

Related U.S. Application Data

(62) Division of application No. 11/740,238, filed on Apr. 25, 2007, now Pat. No. 8,111,271.

(60) Provisional application No. 60/745,785, filed on Apr. 27, 2006.

(51) Int. Cl.
*G09G 5/10* (2006.01)

(52) U.S. Cl. ..... 345/691; 345/89; 345/690

(58) Field of Classification Search ..... 345/87–89, 345/204–215, 690–699
See application file for complete search history.

(56) References Cited

U.S. PATENT DOCUMENTS

| | | | | |
|---|---|---|---|---|
| 5,905,482 | A | 5/1999 | Hughes et al. | |
| 6,369,782 | B2 | 4/2002 | Shigeta | |
| 6,587,084 | B1 | 7/2003 | Alymov et al. | |
| 6,784,898 | B2 | 8/2004 | Lee et al. | |
| 6,924,824 | B2 | 8/2005 | Adachi et al. | |
| 8,111,271 | B2 * | 2/2012 | Hudson et al. | 345/691 |
| 2002/0140662 | A1 | 10/2002 | Igarashi | |
| 2003/0058195 | A1 | 3/2003 | Adachi et al. | |
| 2005/0088462 | A1 | 4/2005 | Borel | |
| 2005/0195894 | A1 | 9/2005 | Kim et al. | |

OTHER PUBLICATIONS

Kang et al., "Digital Driving of TN-LC for WUXGA LCOS Panel," Digest of Technical Papers, Society for Information Display, 2001, pp. 1264-1267.

* cited by examiner

*Primary Examiner* — Vijay Shankar
(74) *Attorney, Agent, or Firm* — Bacon & Thomas, PLLC

(57) ABSTRACT

Methods, apparatus, and systems for generating drive sequences for pulse width modulated displays are described. A pulse width modulated signal that includes a drive sequence of temporal segments that are activated and deactivated to produce a desired gray scale. The temporal segments can be non-binary, non-equally weighted. The drive sequence can also include at least two of the temporal segments are least significant bit segments and the other segments are higher order segments.

10 Claims, 28 Drawing Sheets

Additive Bit Sequence 922 920

| CURVE SEGMENT ↓ | LUMINANCE UNITS PER VOLT |
|---|---|
| LOW | 25.64 |
| MID | 173.10 |
| HIGH | 50.00 |

1032 1030

| CURVE SEGMENT↓ | LUMINANCE UNITS PER INTENSITY CODE |
|---|---|
| LOW | 0.050 |
| MID | 0.271 |
| HIGH | 0.043 |

OR

OR

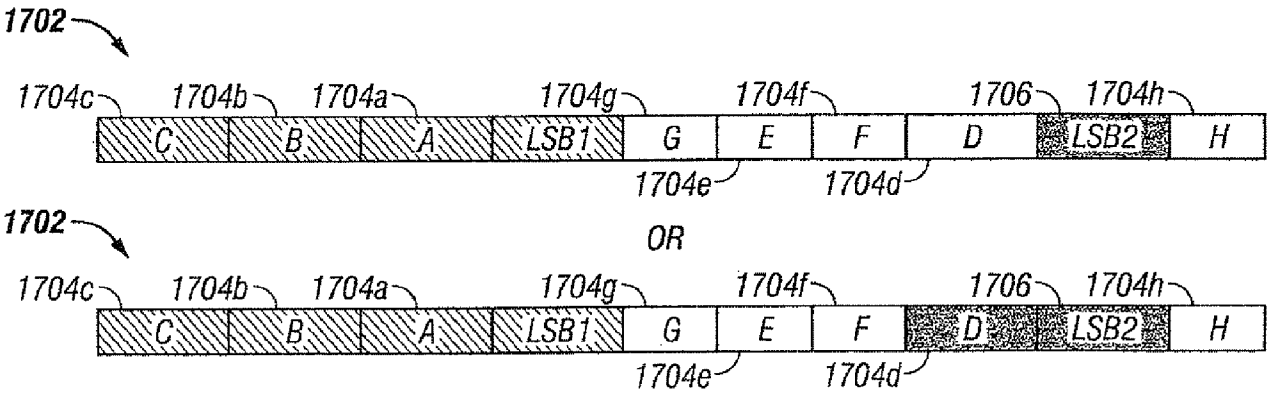
FIG. 17D
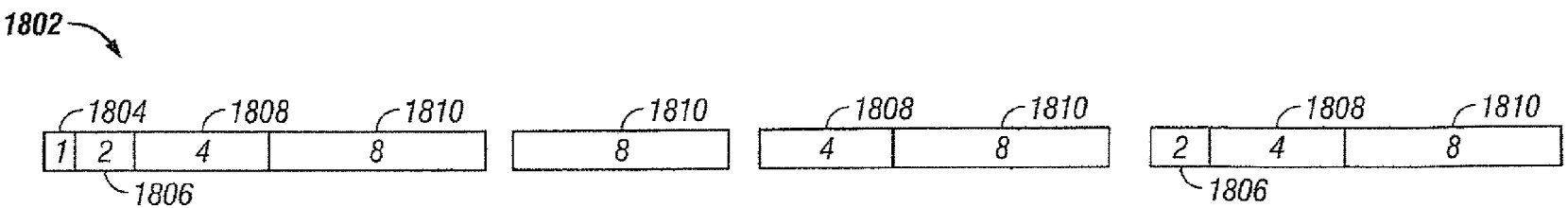
FIG. 18A
FIG. 18B
FIG. 18C
FIG. 18D

GRAY SCALE DRIVE SEQUENCES FOR PULSE WIDTH MODULATED DISPLAYS

RELATED APPLICATIONS

This application is a Divisional application of U.S. patent application Ser. No. 11/740,238, filed Apr. 25, 2007 now U.S. Pat. No. 8,111,271, which claims the benefit of U.S. provisional patent applications Ser. No. 60/745,785, filed Apr. 27, 2006, entitled "Improved Gray Scale Drive Sequences" which is hereby incorporated by reference in its entirety.

BACKGROUND

1. Field of the Invention

This invention relates generally to displays, and in particular to generating drive sequences for pulse width modulated displays 2. Background The development of synthetic displays has been ongoing for many years. It is desired to faithfully and accurately reproduce the image of an object on the displays. One impediment to accurate reproduction of an image is non-linearity of intensity reproduction. A correction factor used in display systems to compensate for the non-linearity is referred to as gamma correction. In addition to non-linearity there are other artifacts in rendering an image on the display that can adversely affect the image. Two such artifacts are referred to as static image contours and dynamic false contouring (DFC).

Gamma can be defined as a numerical parameter that describes the non-linearity of intensity reproduction. Gamma correction can be applied to a display driving signal, or intensity value, to compensate for this non-linearity.

This definition of gamma is accurate for displays based on cathode ray tube (CRT) technology however in displays, such as liquid crystal displays, gamma correction has evolved to include all deviations from accurate reproduction of an image. For example, the Voltage-Transfer curve of a liquid crystal display is generally piecewise linear. Also, the digital to analog converters (DACs) that drive the displays are normally highly linear and the gamma function itself is exponential. In most instances this leads to the use of a lookup table since the relationship between data and luminance for such systems is not easily defined in closed form over the entire range of interest. The declining cost of memory has reduced this to the point of having little impact on the total cost of the display system.

Static image contours exist when an allocation of color codes to a display results in visible lines between sections of an image. The origins of this include having an insufficient number of gray levels available to represent an image and having an incorrect allocation of the color code to the final image. In an example of the former, representing 8 bit color on a display with 5 bits of color depth creates jumps in the appearance of an image where the image should appear to be smoothly shaded. In the latter the appearance is better but there are still these contour lines present in some instances.

Dynamic false contouring (DFC) is an artifact in pulse width modulated displays that is caused by human perception of adjacent pixels in motion where the data written on adjacent pixels are displaced in time substantially. DFC causes pixels to be perceived at incorrect brightness levels when adjacent pixels are presented temporally out of phase to each other. Displays, such as digital liquid crystal displays, that use pulse width modulation to vary the intensity, or gray level, of pixels of the displays are prone to DFC.

A variety of digital liquid crystal display systems have developed over time. Digital liquid crystal displays encompass displays that use pulse width modulation to develop gray scale. These devices typically select between two voltages to switch between a bright state and a dark state, with the gray scale being determined by the time ratio of the two states. The majority of displays that use this type of modulation use either ferroelectric liquid crystals (FLC) in a surface stabilized FLC (SSFLC) configuration or nematic liquid crystals in a variety of other configurations.

Generation of gray scale using pulse width modulation with liquid crystal display devices is quite similar to the techniques used to generate pulse width modulation for plasma panels and other PWM devices such as the Texas Instrument digital light projector (DLP) micro-mirror device.

Plasma panel displays operate a simpler form of pulse width modulation. The plasma pixel cells operate in an on/off constant intensity mode. Each pixel is preloaded with a charge that determines whether or not it will ring up. The high voltage is then released to the cells and those that are pre-charged ring up to their uniform luminance state. At the end of display period another circuit extinguishes the plasma state and the next pixel pre-charge cycle begins. This means that there is always a "dead time" after a display state to permit pre-charge of the next pixels to be displayed in the next display state. This type of display is also prone to DFC.

As noted, DFC is caused by the human perception of adjacent pixels in motion where the data on the two pixels are displaced in time substantially. There are numerous techniques proposed to counter this defect. Many techniques involve temporally splitting higher order bits, for example, displaying a drive value of 128 out of a possible maximum drive value of 255 (128/255) in two segments, each a nominal drive value of 64 (64/255), with some temporal separation between the two segments. Other techniques include adding additional non-binary weighted planes to provide redundant data paths for the creation of individual gray scales. These techniques all have an adverse consequence of reducing the brightness of the system because each additional plane of data requires an additional pre-charge cycle during which no data can be shown. As a consequence these techniques often require that one or more lower order bits be dropped, thus reducing the gray scale depth of the system.

Digital micro-mirror devices, such as DLP, suffer from defects similar to those seen in plasma panels. The available techniques to counter the defects are different because a backplane on micro-mirror devices can be loaded with new data while current data is being shown. A fairly effective solution is to raise the frame rate, which has been shown empirically to reduce the visibility of dynamics false contouring. Most prominent defect seen in DLP devices are motion artifacts seen in field sequential color, such as color breakup.

Liquid crystal (LC) display devices operate in a manner analogous to the above devices. The digital data for the display is parsed in the form of pulse width modulation to form a time varying LC state that modulates the polarization state of light incumbent on it and thus creates gray scale. SSFLC devices are similar to plasma panels and micro-mirror devices because the electrical modulation waveform and the light modulation are quite similar. SSFLC devices typically have rapid, symmetrical on/off times that make static gray scale images quite uniform, although dynamic images still suffer from the dynamic false contouring artifact. Because of the unique spontaneous polarization characteristic of the SSFLC under drive, DC balancing of the display causes it to display the inverse of the image during such times. Thus, techniques are employed to insure the inverse image is not displayed, which is one reason why SSFLC projection display devices have not become widespread in display systems where the lamp intensity cannot be easily modulated. Uniquely, the rise and fall times of SSFLC cells are identical, largely because, as is well known in the art, the common plane ITO voltage is intermediate between the dark state voltage and the bright state voltage.

Backplane devices capable of delivering pulse width modulation are well known in the art. Examples are disclosed in US Patent Application Publication No. 2004/0125090 and 2004/0125094, both assigned to the Assignee of the present application and incorporated by reference herein, in their entirety. Pulse width modulation sequences that can be applied to such backplanes are disclosed in U.S. patent application Ser. No. 2003/0210257 which is incorporated by reference herein, in its entirety.) These devices are quite similar to digital memory devices and they may use either DRAM or SRAM technology to store a value in the pixel circuitry that selects either a dark state voltage or a bright state voltage.

Nematic liquid crystal devices, when driven with pulse width modulation, are similar in some respects to the previous mentioned displays. A fundamental difference is that the electrical waveform used to drive the liquid crystal operates at a frequency much higher than the frequency response of the liquid crystal itself The net effect is that the liquid crystal modulation effects are a smoothed version of the envelope of the drive waveform. The degree of smoothing depends in large measure on the step response of the liquid crystal device. Typical device speed may very from as fast as 250 microseconds to as slow as 30 milliseconds, so the range of variation is enormous.

Nematic liquid crystal devices have substantial rise and fall times, which can affect the appearance of the display. Also, nematic microdisplays can be prone to lateral field artifacts because the ratio of the cell gap to the pixel pitch is generally significantly higher than in direct view devices. Direct view devices suffer similar artifacts but they form a small part of the image. Nematic devices also are still liable to exhibit dynamic false contouring in those instances where the nematic liquid crystal response time is sufficiently fast. Finally, the material has an inherent deviation from the ideal of the gamma curve. While not a defect per se it is a circumstance that requires adaptation.

Therefore, there is a need for improved systems, apparatus, and techniques for improved gray scale drive sequence for pulse width modulated displays.

SUMMARY

The present invention includes methods, apparatuses, and systems as described in the written description and claims. In one example, techniques for an improved gray scale drive sequence for pulse width modulated displays are described. In one embodiment, a method for providing a drive sequence for a pulse width modulated display includes determining a set of non-binary, non-equal, weighted temporal segments. Then assembling the set of segments into a sequence with selected segments in the sequence active. Then using the sequence to pulse width modulate pixels in a display, wherein a pixel's brightness corresponds to the number of active temporal segments in the sequence.

In one embodiment, higher order segments in the sequence increase in weighting monotonically. Also, the weighting of the segments is adjusted to produce a gray scale output corresponding to the number of active segments in the sequence that simulates a gamma curve.

In another embodiment, the sequence includes at least two least significant bit segments. The at least two least significant bit segments can be located in the sequence adjacent to each other, or not adjacent to each other. Also, the temporal activation of the segments can be discontinuous. In addition, the sequence can include non-contiguous time slots.

In another embodiment, a display includes a plurality of plurality of pixels. The display also includes a voltage controller that provides at least one voltage supply that is applied to the pixels in the display. The display also includes a processor that receives image data and determines a set of non-binary, non-equal, weighted temporal segments based on the image data, and assembles the set of segments into a sequence, wherein selected segments are activated in accordance with a desired brightness level of pixels within the display and the sequence includes at least two least significant bit segments.

In another embodiment, a controller for a pulse width modulated display includes a voltage controller that provides at least one voltage supply that is applied to pixels in a displa. The controller also includes a processor that receives image data and determines a set of non-binary, non-equal, weighted temporal segments based on the image data, and assembles the set of segments into a sequence, wherein selected segments are activated in accordance with a desired brightness level of pixels within the display and the sequence includes at least two least significant bit segments.

Other features and advantages of the present invention should be apparent after reviewing the following detailed description and accompanying drawings which illustrate, by way of example, aspects of the invention.

BRIEF DESCRIPTION OF THE DRAWINGS

The details of the present invention, both as to its structure and operation, may be gleaned in part by study of the accompanying drawings, in which like reference numerals refer to like parts.

FIG. 17D is a block diagram of still another embodiment of a drive sequence.

FIG. 18A is a block diagram illustrating an embodiment of an LSB segment.

FIG. 18B is a block diagram illustrating an alternative variation between the nature of the first and second LSB segments, such as the LSB segments illustrated in FIGS. 14-17.

FIG. 18C is a block diagram illustrating another alternative variation between the nature of the first and second LSB segments.

FIG. 18D is a block diagram illustrating still another alternative variation between the nature of the first and second LSB segments.

DETAILED DESCRIPTION

Certain embodiments as disclosed herein provide for methods and systems for techniques that provide improved gray scale drive sequences in pulse width modulated displays. After reading this description it will become apparent how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention as set forth in the appended claims.

In one embodiment, drive sequences for a pulse-width modulated liquid crystal display that reduce, or minimize, certain classes of defects in pulse width modulated displays are described. The sequences described can reduce the deleterious effects of motion contouring and static contouring in the displays. In addition, techniques are described that reduce the bandwidth required to achieve better conformance to CRT type gamma corrected display intensities in displays for human usage.

The development of synthetic displays has been ongoing for many years. During that time a body of practice has developed that is widely accepted. The usage of certain terms developed for the times when all displays were CRTs has continued into the era of liquid crystal displays. Some of the terms used herein are perhaps slightly outside the meaning of the original term but well within the common usage of the display industry.

Dynamic false contouring (DFC) is an artifact in pulse width modulated displays that is caused by human perception of adjacent pixels in motion where the data on the two pixels are displaced in time substantially. DFC causes pixels to be perceived at incorrect brightness levels when adjacent pixels are presented temporally out of phase to each other.

Various techniques for pulse width modulating displays have been developed. One such technique is described in U.S. Pat. No. 6,005,558, incorporated herein by reference in its entirety, which describes using equal, non-binary, temporal bit weighting.

Figure 1A:
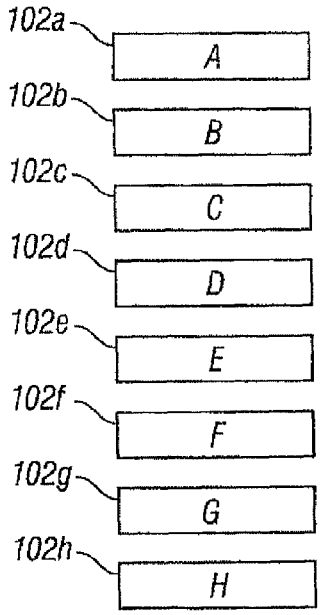
FIG. 1A is a block diagram illustrating a set of equal, non-binary, temporal segments that can be used to activate an element of a display.
Figure 1B:
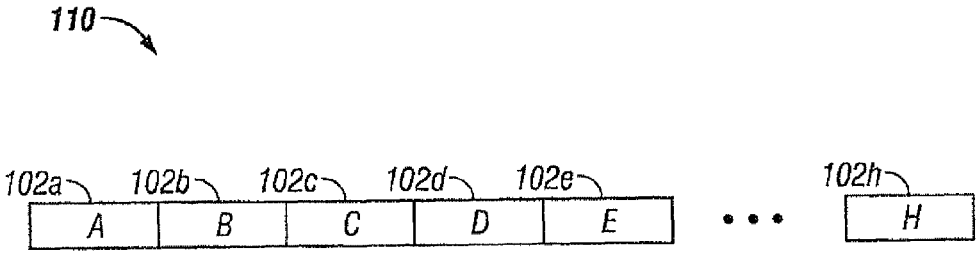
FIG. 1B presents a time sequence using the equal, non-binary, temporal segments of FIG. 1A.

FIG. 1A is a block diagram illustrating a set of equal, non-binary, temporal segments 102*a-h* that can be used to activate an element of a display. FIG. 1B presents a drive sequence using the equal, non-binary, temporal segments of FIG. 1A. As shown in FIG. 1B, a time-ordered drive sequence 110 is made up of time slots. The first time slot is filled with the first temporal segment 102*a*, followed by a second time slot that is filled with the second temporal segment 102*b*, and so forth until all of the time slots are filled with temporal segments 102*a-h*.

Figure 1C:
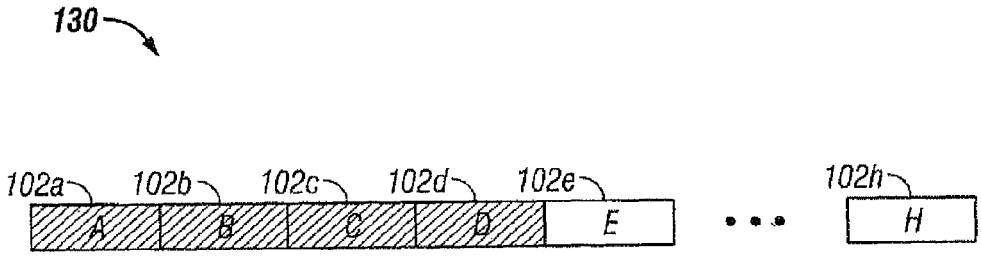
FIG. 1C is a diagram illustrating an example of using the drive sequence of FIG. 1B to produce a gray scale.
Figure 1D:
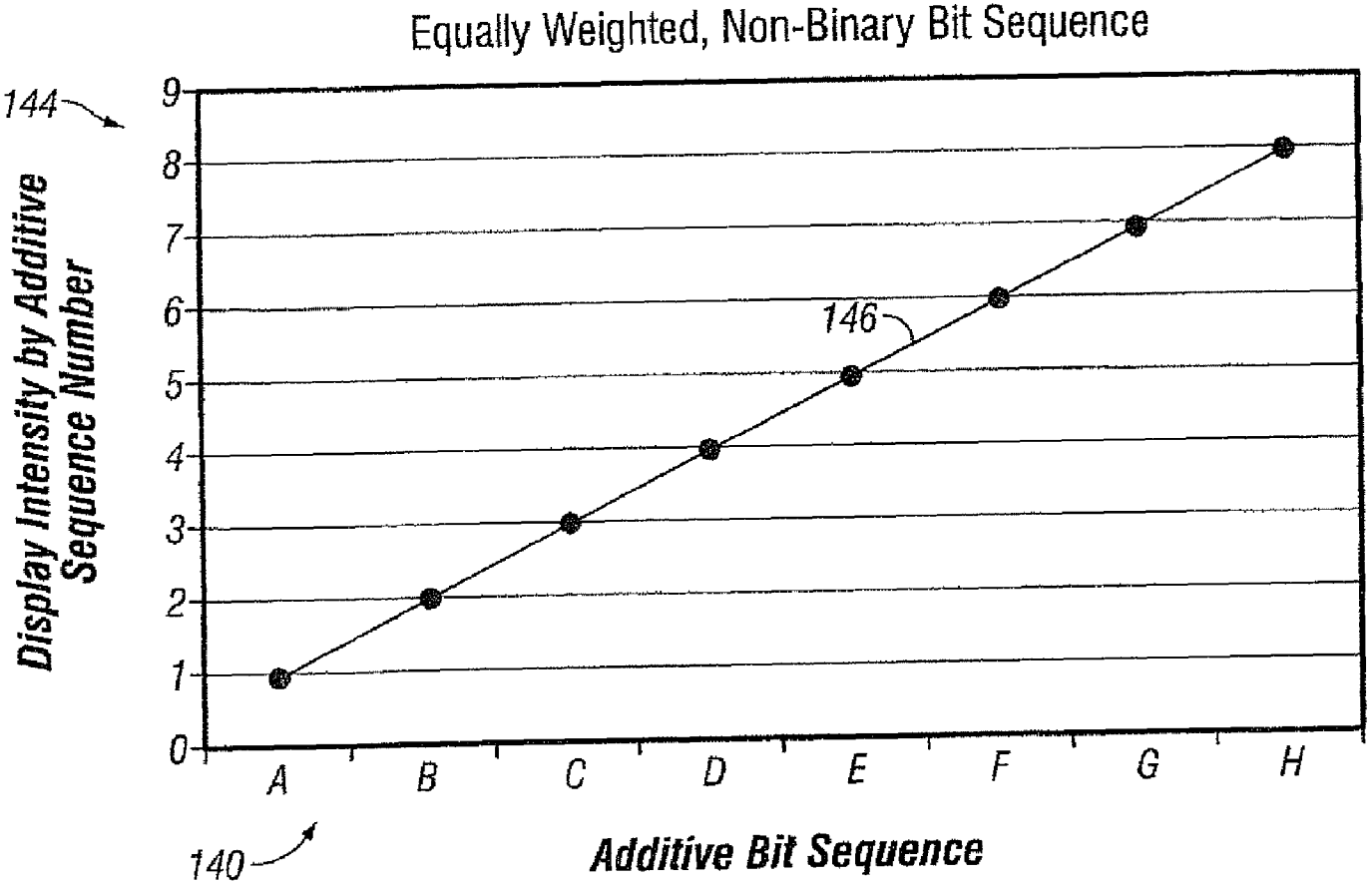
FIG. 1D is a chart illustrating an idealized luminosity resulting from an equally-weighted, time-ordered, drive sequence.

FIG. 1C is a diagram illustrating an example of using the drive sequence of FIG. 1B to produce a gray scale. In FIG. 1C, a gray scale needing half of the temporal segments in the time sequences to be active or "on" is displayed. As shown in FIG. 1C, temporal segments 102*a-d* fill the first four time slots of the drive sequence 130 and the remainder of the drive sequence is empty. By adjusting the number of time slots that are filled active with temporal segments, the intensity of a display driven by the drive sequence can be adjusted. FIG. 1D is a chart illustrating an idealized luminosity resulting from an equally-weighted, time-ordered, drive sequence. As shown in FIG. 1D, the horizontal axis 140 represents the number of active temporal segments included in the drive sequence, and the vertical axis 144 represents the relative display intensity. The curve 146 illustrates the relation between the number of temporal segments in the drive sequence to the intensity. FIG. 1D illustrates a ideal luminance gray scale curve resulting from the time sequence of FIG. 1B when each temporal segments is added to the sequence in turn. Inspection of the Curve 146 in FIG. 1D shows a nearly linear relation between the number of temporal segments in the drive sequence and the relative display intensity. It is noted FIG. 1D illustrates an idealized model that is not necessarily realizable.

Figure 2A:
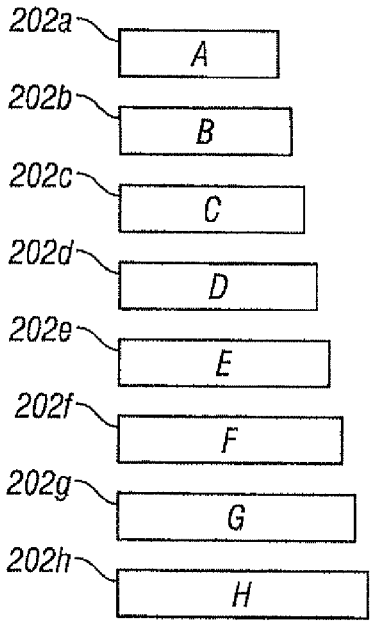
FIG. 2A is a block diagram illustrating a set of non-equal, non-binary, temporal segments.
Figure 2B:
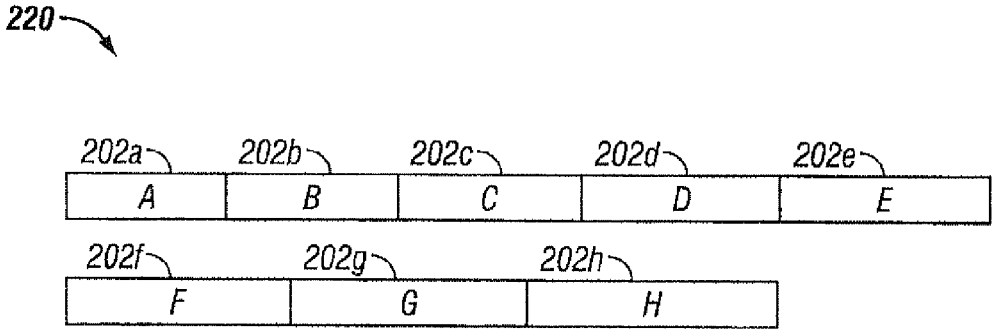
FIG. 2B presents a time sequence using the non-equal, non-binary, temporal segments of FIG. 2A.

FIG. 2A is a block diagram illustrating a set of non-equal, non-binary, temporal segments 202*a-h*. In the example of FIG. 2A, the temporal weighting of each temporal segment, or sequence item, 202*a-h* that can be used to activate an element of a display increases monotonically. FIG. 2B presents a time sequence using the non-equal, non-binary, temporal segments of FIG. 2A. As shown in FIG. 2B, a time-ordered drive sequence 210 is made up of unequal time slots that are filled with the temporal segments 202*a-h*. The first time slot is filled with the first temporal segment 202*a*, followed by a second time slot that is filled with the second temporal segment 202*b*, and so forth until all of the time slots are filled with temporal segments 202*a-h*.

Figure 2C:
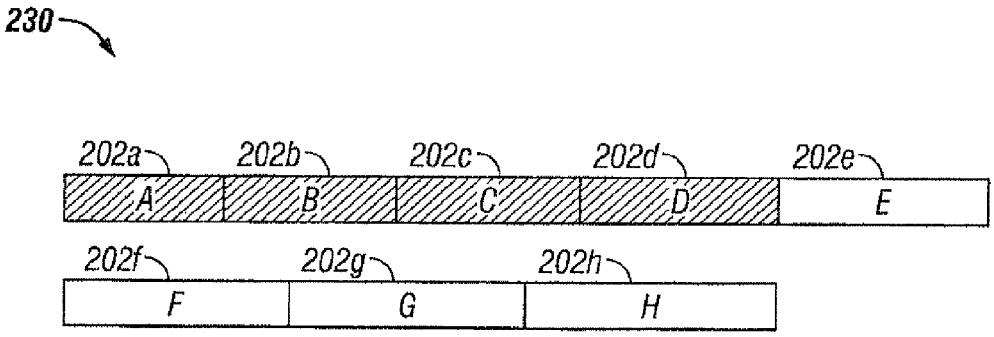
FIG. 2C is a diagram illustrating an example of using the drive sequence of FIG. 2B to produce a gray scale.

FIG. 2C is a diagram illustrating an example of using the drive sequence of FIG. 2B to produce a gray scale. In FIG. 2C, a gray scale using half of the time slots in the drive sequence as active is shown. As shown in FIG. 2C, temporal segments 202*a-d* fill the first four time slots of the drive sequence 230 and the remainder of the drive sequence is empty or filled with deactivated sequences. By adjusting the number of time slots that are filled with active temporal segments, the intensity of a display driven by the drive sequence can be adjusted. In the example of FIG. 2C, even though half of the time slots are filled, less than half of the total duration of the time sequence 230 is active.

Figure 2D:
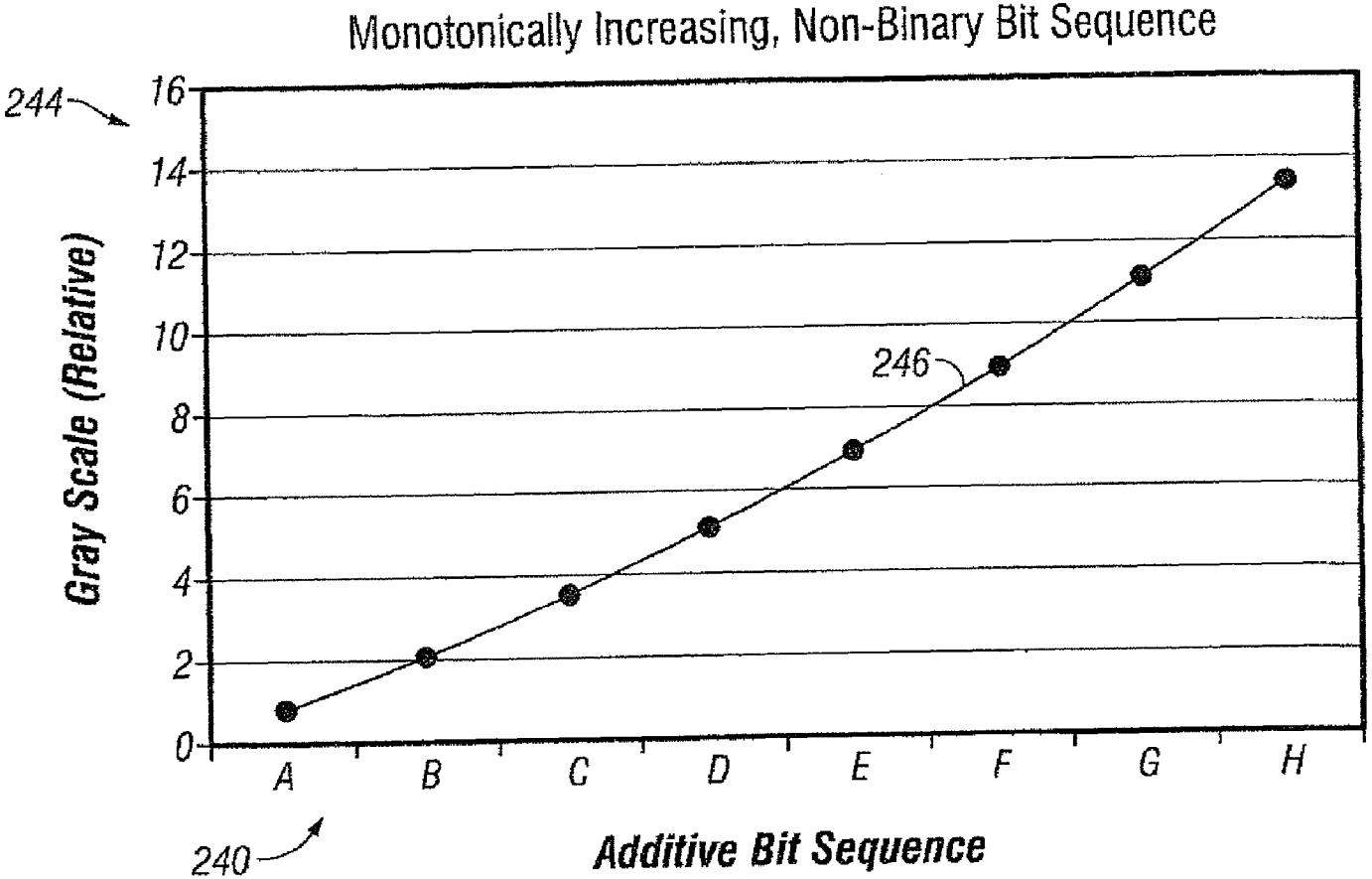
FIG. 2D is a chart illustrating an idealized luminosity resulting from a non-equal, non-binary, weighted time-ordered drive sequence.

FIG. 2D is a chart illustrating an idealized luminosity resulting from a non-equal, non-binary, weighted time-ordered drive sequence. As shown in FIG. 2D, the horizontal axis 240 represents the number of temporal segments included in the drive sequence, and the vertical axis 244 represents the relative display intensity. The curve 246 illustrates the relation between the number of temporal segments in the drive sequence to the intensity. FIG. 2D illustrates a ideal luminance gray scale curve resulting from the time sequence of FIG. 1B when each temporal segments is added to the sequence in turn. Inspection of the Curve 246 in FIG. 2D shows a non-linear relation between the number of bits in the drive sequence and the relative display intensity. The curve 246 is generally "bending up" similar to a "power law" curve (plot of a number raised to a power), such as a gamma curve. Using a time sequence such as illustrated in FIG. 2C can be used to compensate for variations in display intensity.

Figure 3A:
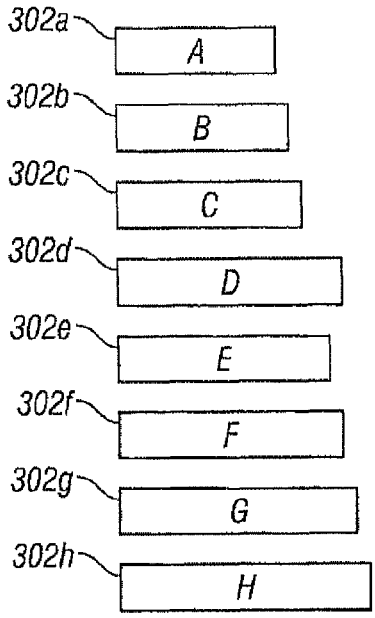
FIG. 3A is a block diagram illustrating another example set of non-equal, non-binary, temporal segments.
Figure 3B:
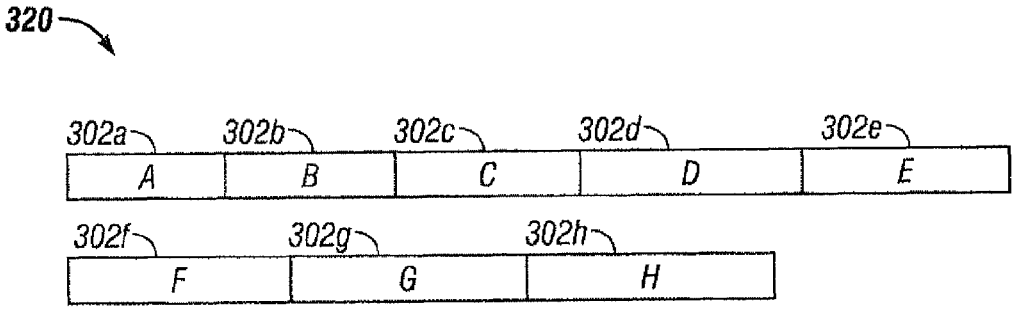
FIG. 3B presents a time sequence using the non-equal, non-binary, non-monotonic temporal segments of FIG. 3A.

FIG. 3A is a block diagram illustrating another example set of non-equal, non-binary, temporal segments 302*a-h*. FIG. 3A illustrates an example of a set of non-binary, non-equally weighted, temporal weighting in which the temporal weighting of each temporal segments 302*a-h* may be non-monotonic at points. FIG. 3B presents a time sequence using the non-equal, non-binary, non-monotonic temporal segments of FIG. 3A. As shown in FIG. 3B, a time-ordered drive sequence 310 is made up of unequal time slots that are filled with the bits 302*a-h*. The first time slot is filled with the first temporal segments 302*a*, followed by a second time slot that is filled with the second temporal segments 302*b*, and so forth until all of the time slots are filled with temporal segments 302*a-h*.

Figure 3C:
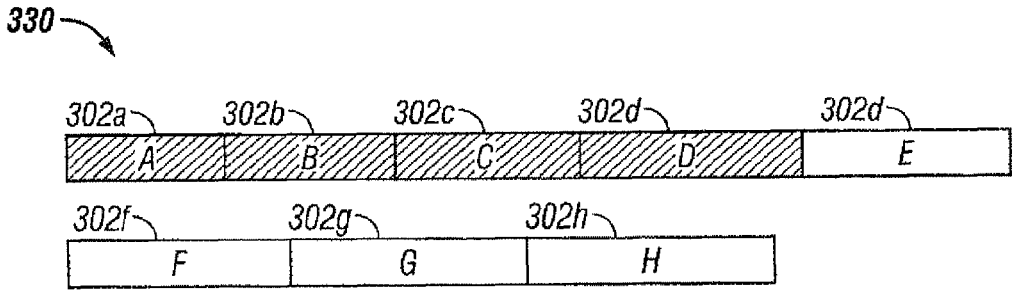
FIG. 3C is a diagram illustrating an example of using the drive sequence of FIG. 3B to produce a gray scale.

FIG. 3C is a diagram illustrating an example of using the drive sequence of FIG. 3B to produce a gray scale. In FIG. 3C, a gray scale using half of the time slots in the time sequence are active. As shown in FIG. 3C, temporal segments 302*a-d* fill the first four time slots of the drive sequence 330 and the remainder of the drive sequence is empty. By adjusting the number of time slots that are filled with temporal segments, the intensity of a display driven by the drive sequence can be adjusted.

Figure 3D:
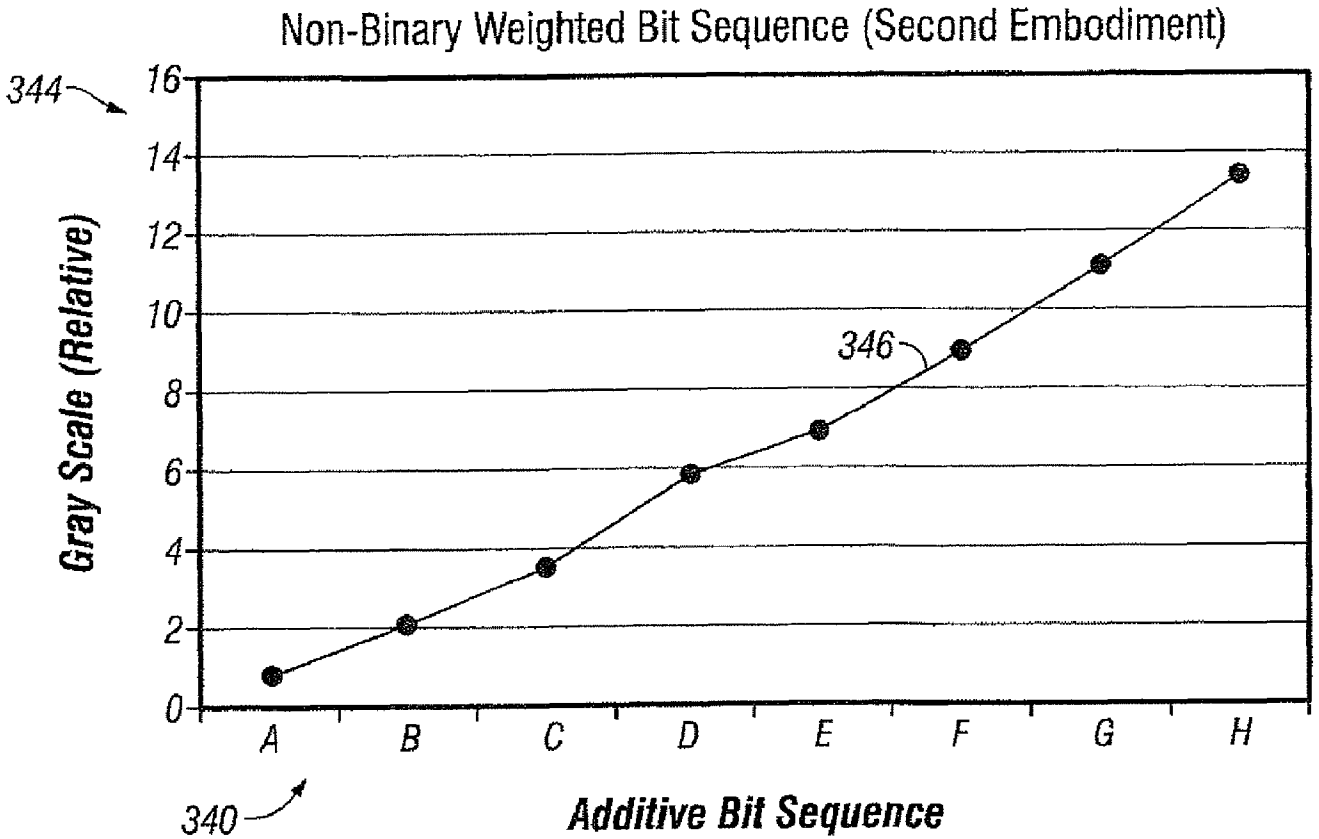
FIG. 3D is a chart illustrating an idealized luminosity resulting from a non-equal, non-binary, non-monotonically weighted time-ordered drive sequence.

FIG. 3D is a chart illustrating an idealized luminosity resulting from a non-equal, non-binary, non-monotonically weighted time-ordered drive sequence. As shown in FIG. 3D, the horizontal axis 340 represents the number of temporal segments included in the drive sequence, and the vertical axis 344 represents the relative display intensity. The curve 346 illustrates the relation between the number of temporal segments in the drive sequence to the intensity. FIG. 3D illustrates a ideal luminance gray scale curve resulting from the time sequence of FIG. 3B when each temporal segments is added to the sequence in turn. Inspection of the Curve 346 in FIG. 3D shows a discontinuity, or a "bump" in the relation between the number of bits in the drive sequence and the relative display intensity when segment 302*d* is added to the sequence because segment 302*d* is larger than segments 302*a-c*. Also, there is a "dip" in the curve when segment 203*e* is added because segment 302*e* is smaller then segment 302*d*. Using a time sequence such as illustrated in FIG. 3C can be used to compensate for discontinuities and other variations in display intensity.

Figure 4A:
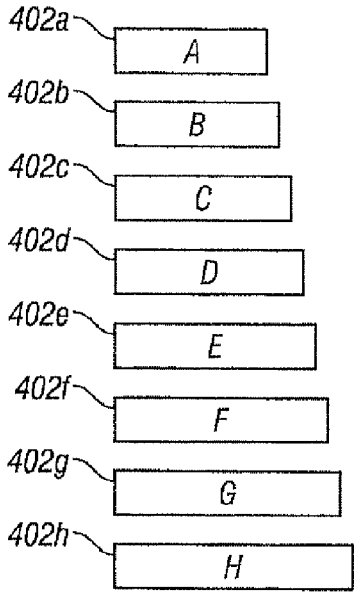
FIG. 4A is a block diagram illustrating another example set of non-equal, non-binary, temporal segments.
Figure 4B:
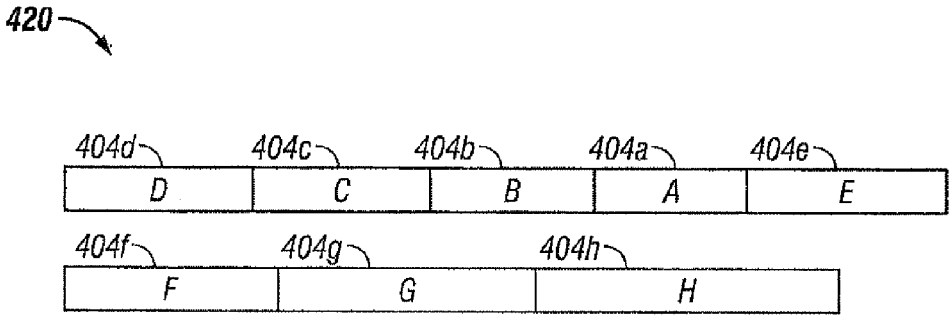
FIG. 4B presents a time sequence 420 using the non-equal, non-binary, monotonic temporal segments of FIG. 4A.

FIG. 4A is a block diagram illustrating another example set of non-equal, non-binary, temporal segments 402*a-h* similar to those illustrated in FIG. 2A. FIG. 4A illustrates an example of a set of non-binary, non-equally weighted, temporal weighting in which the temporal weighting of each temporal segments 302*a-h* is monotonic. FIG. 4B presents a time sequence 420 using the non-equal, non-binary, monotonic temporal segments of FIG. 4A. As shown in FIG. 4B, a time-ordered drive sequence 310 is made in which the temporal order of the presentation of the temporal segments is not in consecutive order, but rather in partial in reverse order and partial in normal, consecutive, order. In the example of FIG. 4B, the first time slot is filled with the fourth temporal segment 402*d*, followed by a second time slot that is filled with the third temporal segment 402*c*, the third time slot is filled with the second temporal segment 402*b*, and the fourth time slot is filled with the first temporal segment 402*a*. The remaining time slots are then filed with temporal segments 402*e-h* is consecutive order.

Figure 4C:
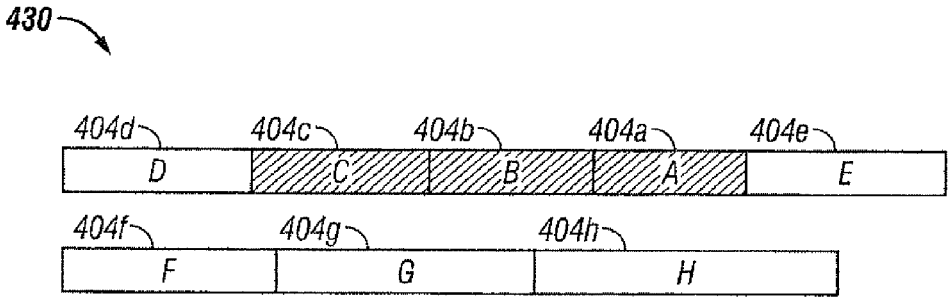
FIG. 4C is a diagram illustrating an example of using a drive sequence 430 of FIG. 4B to produce a gray scale.
Figure 4D:
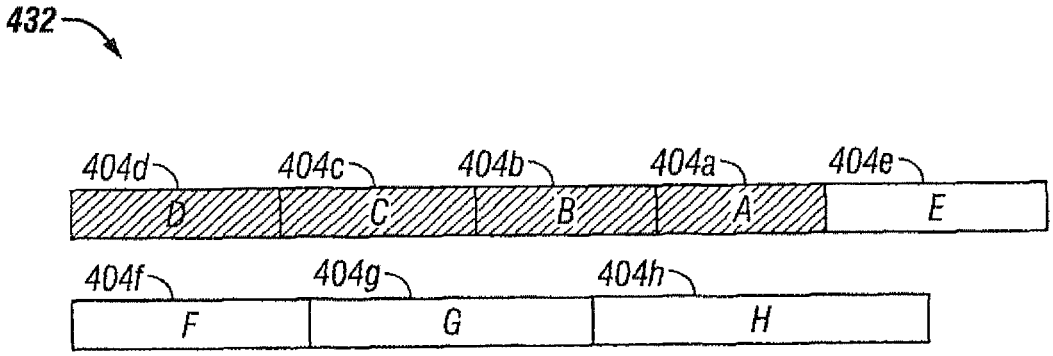
FIG. 4D illustrates a gray scale 432 using four of the timeslots in the time sequence as active.
Figure 4E:
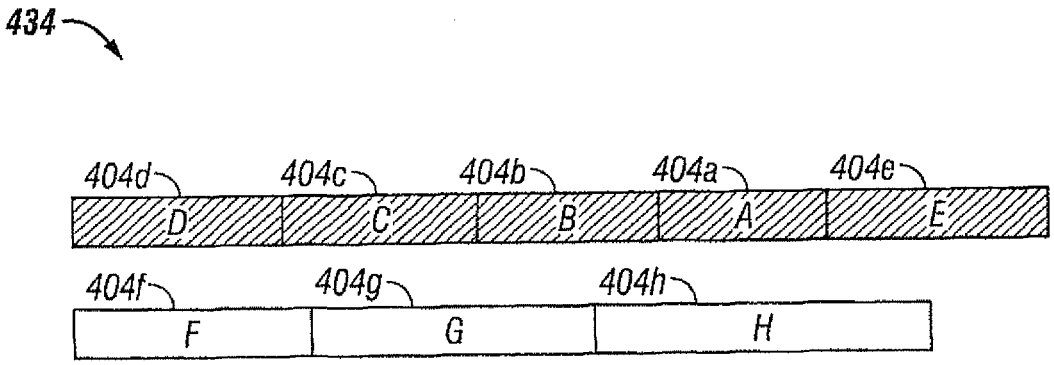
FIG. 4E illustrates a gray scale using five of the timeslots in the time sequence as active.

FIG. 4C is a diagram illustrating an example of using a drive sequence 430 of FIG. 4B to produce a gray scale. FIG. 4C, illustrates a drive sequence where three of the time slots in the time sequence as active. As shown in FIG. 4C, temporal segments 302*a-c* are active and the remainder of the drive sequence is inactive, or empty. FIG. 4D illustrates a drive sequence 432 using four of the timeslots in the time sequence as active. In FIG. 4D, temporal segments 302*a-d* file the first four time slots in the time sequence arranged in reverse order with temporal segment 402*d* in the first time slot, temporal segment 402*c* in the second time slot, temporal segment 402*b*, in the third time slot, and temporal segment 402*a* in the fourth time slot. FIG. 4E illustrates a drive sequence 434 using five of the timeslots in the time sequence as active. In FIG. 4E, temporal segments 302*a-e* file the first five time slots in the drive sequence arranged in reverse order with temporal segment 402*d* in the first time slot, temporal segment 402*c* in the second time slot, temporal segment 402*b*, in the third time slot, and temporal segment 402*a* in the fourth time slot, then, temporal segment 402*e* is in the fifth time slot. It is noted that the active portion of the drive sequences of FIGS. 4D and 4E have the same temporal initiation point, whereas the active portion of the time sequence of FIG. 4C starts later.

Figure 4F:
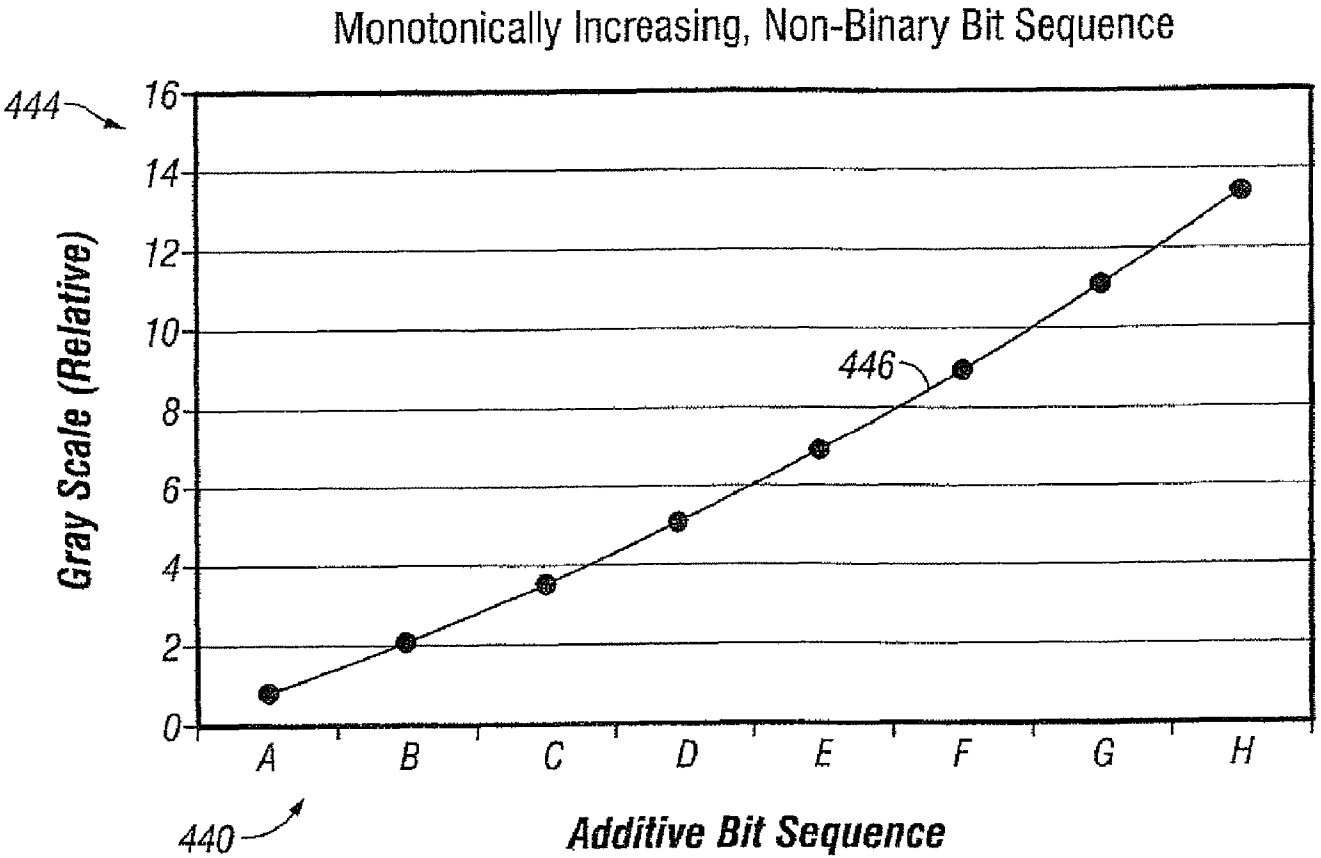
FIG. 4F is a chart illustrating an idealized luminosity resulting from a non-equal, non-binary, monotonically weighted time-ordered drive sequence.

FIG. 4F is a chart illustrating an idealized luminosity resulting from a non-equal, non-binary, monotonically weighted time-ordered drive sequence. As shown in FIG. 4F, the horizontal axis 440 represents the number of temporal segments included in the drive sequence, and the vertical axis 444 represents the relative display intensity. The curve 446 illustrates the relation between the number of temporal segments in the drive sequence to the intensity. Using a time sequence such as illustrated in FIG. 4F can be used to compensate for variations in display intensity.

Figure 5A:
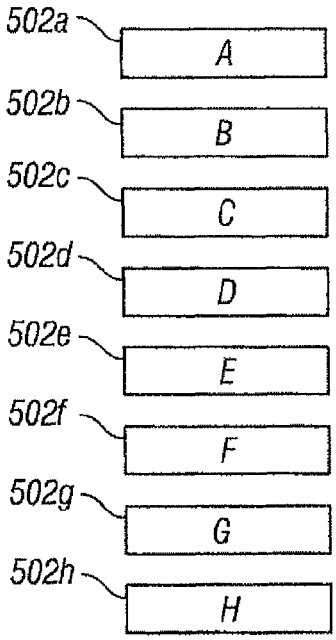
FIG. 5A is a block diagram illustrating another example set of equal, non-binary, temporal segments.
Figure 5B:
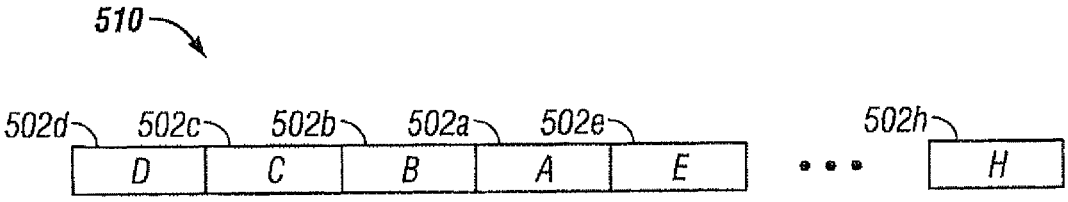
FIG. 5B presents a time sequence using the equal, non-binary, temporal segments of FIG. 5A.

FIG. 5A is a block diagram illustrating an example set of equal, non-binary, temporal segments 502*a-h*. FIG. 5B presents a time sequence 520 using the equal, non-binary, temporal segments of FIG. 5A. As shown in FIG. 5B, a time-ordered drive sequence 510 is made in which the temporal order of the presentation of the segments in not in consecutive order, but rather partial in reverse order and partial in normal, consecutive, order. In the example of FIG. 5B, the first time slot is filled with the fourth temporal segment 502*d*, followed by a second time slot that is filled with the third temporal segment 502*c*, the third time slot is filled with the second temporal segment 502*b*, and the fourth time slot is filled with the first temporal segment 502*a*. The remaining time slots are then filed with temporal segments 502*e-h* is consecutive order.

Figure 5C:
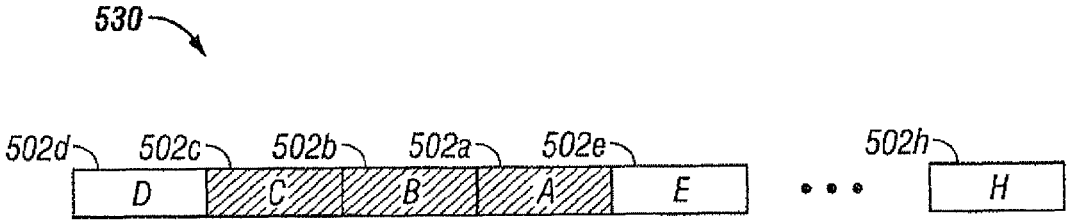
FIG. 5C is a diagram illustrating an example of using a drive sequence of FIG. 5B to produce a gray scale.
Figure 5D:
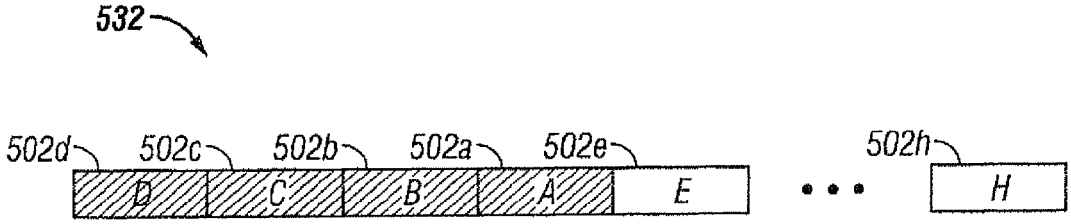
FIG. 5D illustrates a gray scale using four of the timeslots in the time sequence as active.
Figure 5E:
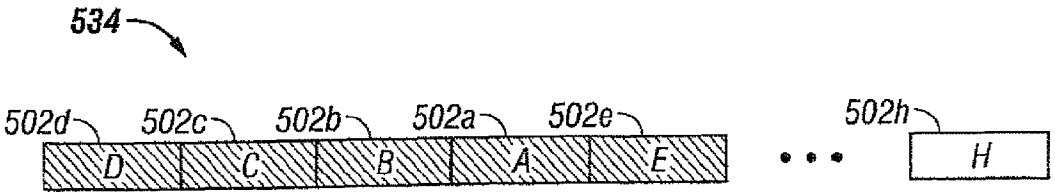
FIG. 5E illustrates a gray scale using five of the timeslots in the time sequence as active.

FIG. 5C is a diagram illustrating an example of using a drive sequence 530 of FIG. 5B to produce a gray scale. The example in FIG. 5C, illustrates a drive sequenc using three of the time slots in the sequence as active. As shown in FIG. 5C, temporal segments 502*a-c* are active and the remainder of the drive sequence is inactive, or empty. FIG. 5D illustrates a drive sequence 532 using four of the timeslots in the sequence as active. In FIG. 5D, temporal segments 502*a-d* file the first four time slots in the drive sequence in reverse order beginning with the second time slot in the sequence. In FIG. 5D, the temporal sequences are arranged in reverse order beginning with the first time slot in the sequence. FIG. 5E illustrates a gray scale 534 using five of the timeslots in the time sequence as active. In FIG. 5E, temporal segments 302*a-d* fill the first four time slots in the time sequence in reverse order, then temporal segment 502*e* fills the next time slot. It is noted that the active portion of the time sequences of FIG. 5D begins temporally before the active portion of the time sequence of FIG. 5C. In addition, the activation portion of the time sequence of FIGS. 5E and 5D have the same temporal initiation point whereas the active portion of the time sequence of FIG. 5C begins later.

Figure 5F:
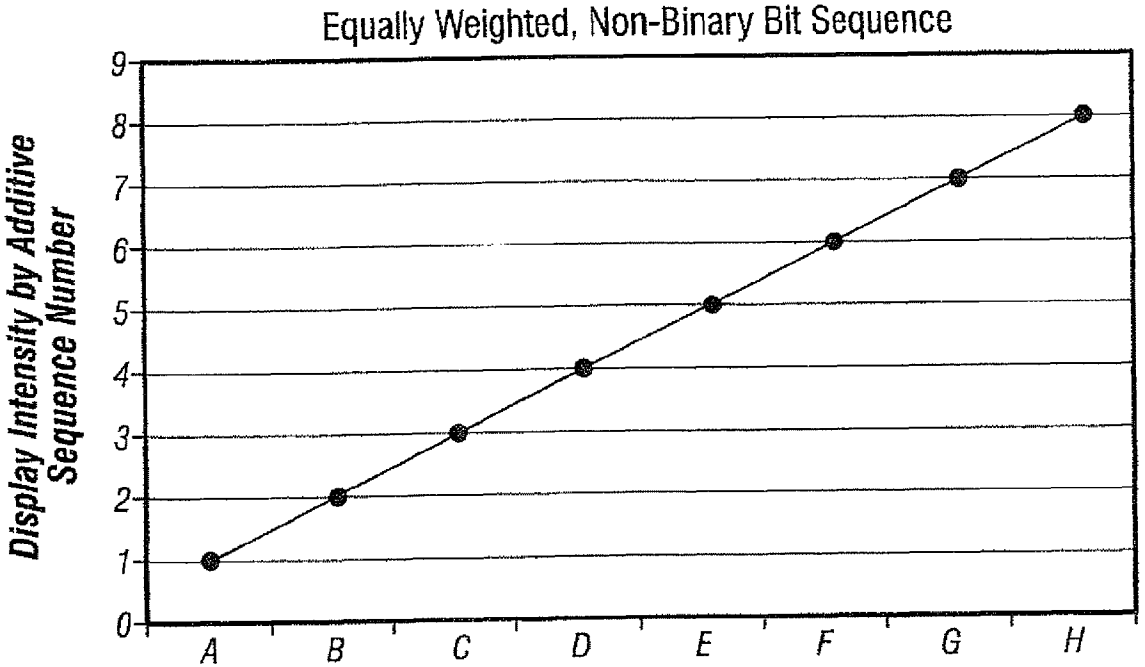
FIG. 5F is a chart illustrating an idealized luminosity resulting from the ordered activation of the sequence for FIG. 5B.

FIG. 5F is a chart illustrating an idealized luminosity resulting from the ordered activation of the sequence for FIG. 5B. As shown in FIG. 5F, the horizontal axis 540 represents the number of temporal segments included in the drive sequence, and the vertical axis 544 represents the relative display intensity. The curve 546 illustrates the relation between the number of temporal segments in the drive sequence to the intensity. Using a time sequence such as illustrated in FIG. 5F can be used to compensate for variations in display intensity.

Figure 6A:
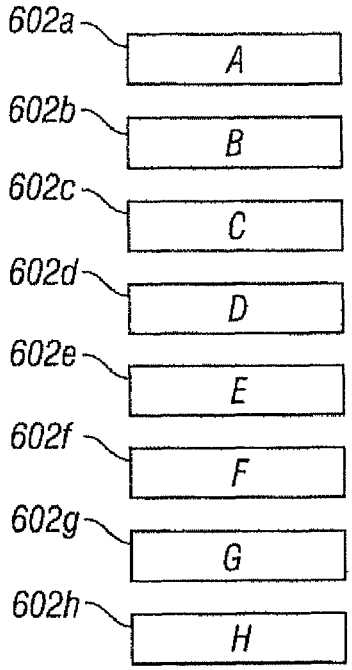
FIG. 6A is a block diagram illustrating still another example set of non-binary, temporal segments.
Figure 6B:
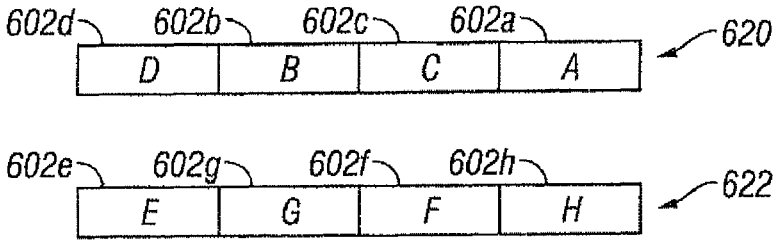
FIG. 6B presents temporally discontiguous time slots using the temporal segments of FIG. 6A.

FIG. 6A is a block diagram illustrating still another example set of non-binary, temporal segments 602*a-h*. In FIG. 6A the temporal segments 602*a-h* are illustrated as equally weight, but in other embodiments, the temporal segments of FIG. 6A may be non-equally weighted. FIG. 6B presents temporally discontiguous time slots 620 and 622 using the temporal segments of FIG. 6A.

Figure 6C:
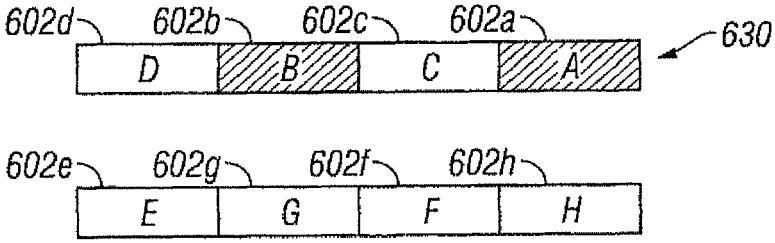
FIG. 6C is a diagram illustrating an example of using the discontiguous time slots of FIG. 6B to produce a gray scale.
Figure 6D:
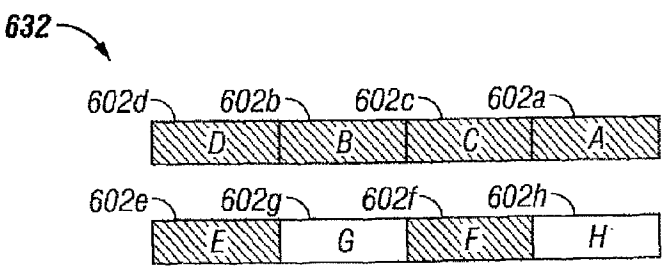
FIG. 6D illustrates a gray scale 632 using six of the timeslots in the time sequence as active.
Figure 6E:
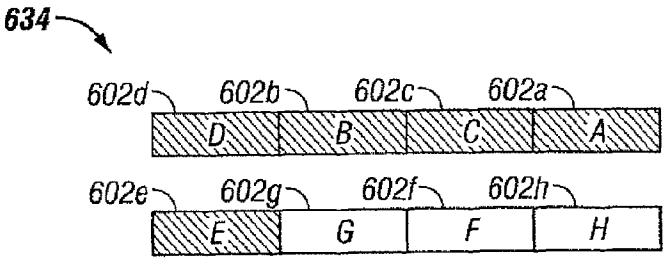
FIG. 6E illustrates a gray scale 634 using five of the timeslots in the time sequence as active.

FIG. 6C is a diagram illustrating an example of using the discontiguous time slots 620 and 622 of FIG. 6B to produce a gray scale drive sequence. The example in FIG. 6C, illustrates a drive sequence using two of the time slots in the time sequence as active. As shown in FIG. 6C, temporal segments 602*a-b* are active and the remainder of the drive sequence is in active, or empty. In FIG. 6C, temporal segment 602*a* fills the fourth time slot and temporal segment 602*b* fills the second time slot of the first discontiguous time sequence. FIG. 6D illustrates a gray scale 632 using six of the timeslots in the time sequence as active. In FIG. 6D, temporal segments 502*a-d* fill the four time slots in the first discontiguous time sequence in reverse order, and temporal segments 602*e* and 602*f* fill the first and third time slots of the second discontiguous time sequence. In FIG. 6D, one active time slot (602*f*) is not contiguous with any other active time slot, while the other five time slots (602*a-e*) are contiguous. FIG. 6E illustrates a gray scale 634 using five of the timeslots in the time sequence as active. In FIG. 6E, temporal segments 602*a-d* fill the four time slots in the first discontiguous time sequence in reverse order, then temporal segment 602*e* fills the first time slot in the second discontiguous time sequence.

Figure 6F:
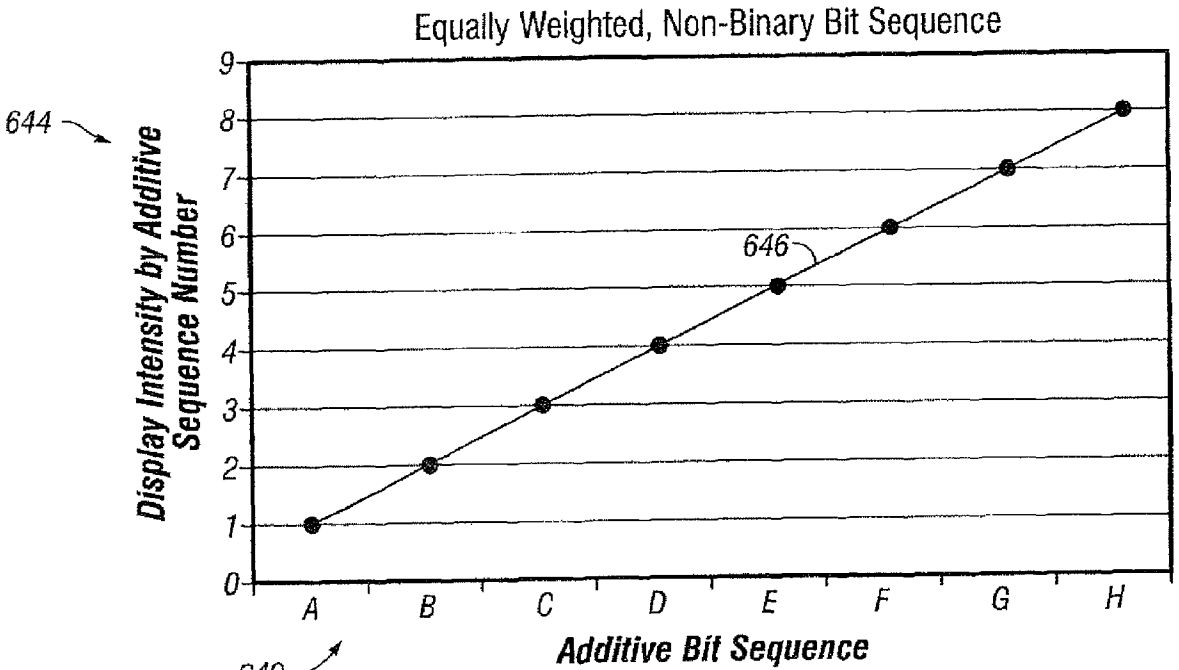
FIG. 6F is a chart illustrating an idealized luminosity resulting from the ordered activation of the sequence for FIG. 6B.

FIG. 6F is a chart illustrating an idealized luminosity resulting from the ordered activation of the sequence for FIG. 6B. As shown in FIG. 6F, the horizontal axis 640 represents the number of temporal segments included in the drive sequence, and the vertical axis 644 represents the relative display intensity. The curve 646 illustrates the relation between the number of temporal segments in the drive sequence to the intensity. Using a time sequence such as illustrated in FIG. 6F can be used to compensate for variations in display intensity.

Nematic Liquid Crystal Display Rise and Fall Time Asymmetries

Nematic liquid crystal displays are typically classified as normally white or normally black, depending on whether the un-driven state of the display elements is bright or dark. Displays may be fabricated either way as adequate liquid crystal materials are available for either. One consequence of the choice of display type is that the liquid crystal device will normally switch to the driven state much faster than it will relax from the driven state to the un-driven state. This asymmetry can become important when generating pulse width modulated gray scales.

In one example of a normally white mode, twisted nematic, electrically controlled birefringence cell (TN-ECB) or a mixed mode twisted nematic (MTN) mode cell, the rise time to white may be on the order of 5 milliseconds, whereas the drive to dark time is more likely to be on the order of 500 microseconds for the same material. When using such a mode with a pulse width modulated display, one sees a rise time of 5 millisecond followed by a sustain time proportional to the remaining time modulation and then a very rapid switch-off. If the segments of the pulse width modulation are adjacent to one another, then the brightness achieves a certain level. If, on the other hand, there is one or more discontinuities in the pulse width modulation, then the same overall drive time will have two rise times rather than one. If a line of one modulation were displayed next to a line of the second modulation, they will appear to have different intensities even though the drive times are identical.

This problem of non-linear performance of the liquid crystal material is one of the difficulties encountered by pulse width modulated displays using nematic liquid crystal materials. There are also non-linearities within the response of the liquid crystal materials, and further there is a strong desire in display systems to make the luminosity conform to a gamma corrected curve that accurately represents gray levels.

Figure 7A:
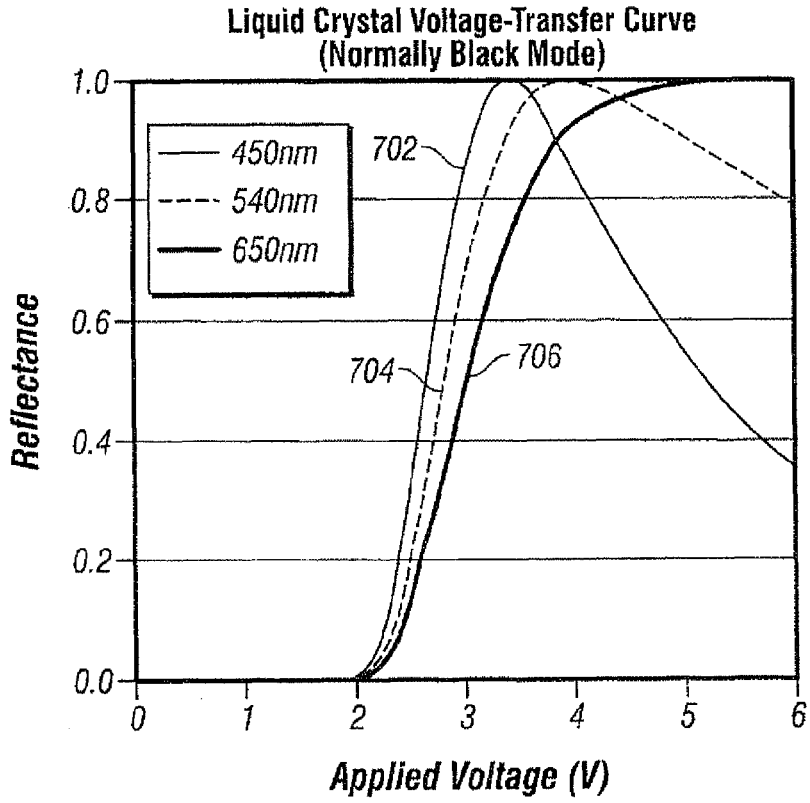
FIG. 7A is a chart illustrating a typical voltage transfer curve for a normally black nematic liquid crystal material at three different wavelengths, 450, 540, and 650 nanometer.
Figure 7B:
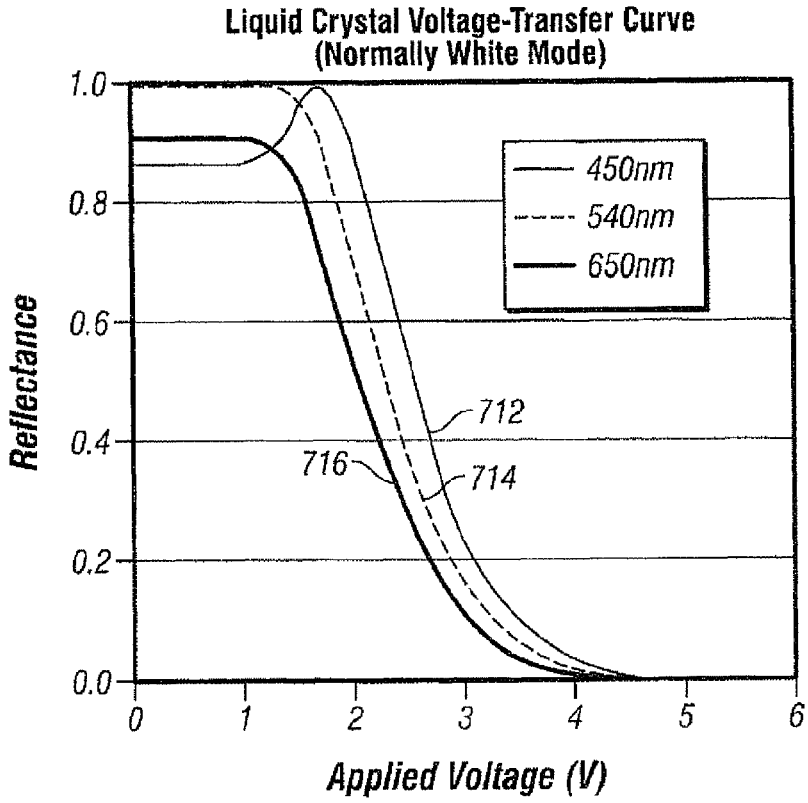
FIG. 7B is a chart illustrating a typical voltage transfer curve for a normally white nematic liquid crystal material at three different wavelengths, 450, 540, and 650 nanometer.

FIG. 7A is a chart illustrating a typical voltage transfer curve for a normally black nematic liquid crystal material at three different wavelengths, 450 nanometer (702), 540 nanometer (704), and 650 nanometer (706). FIG. 7B is a chart illustrating a typical voltage transfer curve for a normally white nematic liquid crystal material at three different wavelengths, 450 nanometer (712), 540 nanometer (714), and 650 nanometer (716). In both FIG. 7A and 7B, the horizontal axis is the applied voltage and the vertical axis is the relative reflectance. The curves of FIGS. 7A and 7B are typical data of the type often measured or predicted by modeling and are well know to those skilled in the art.

Figure 8:
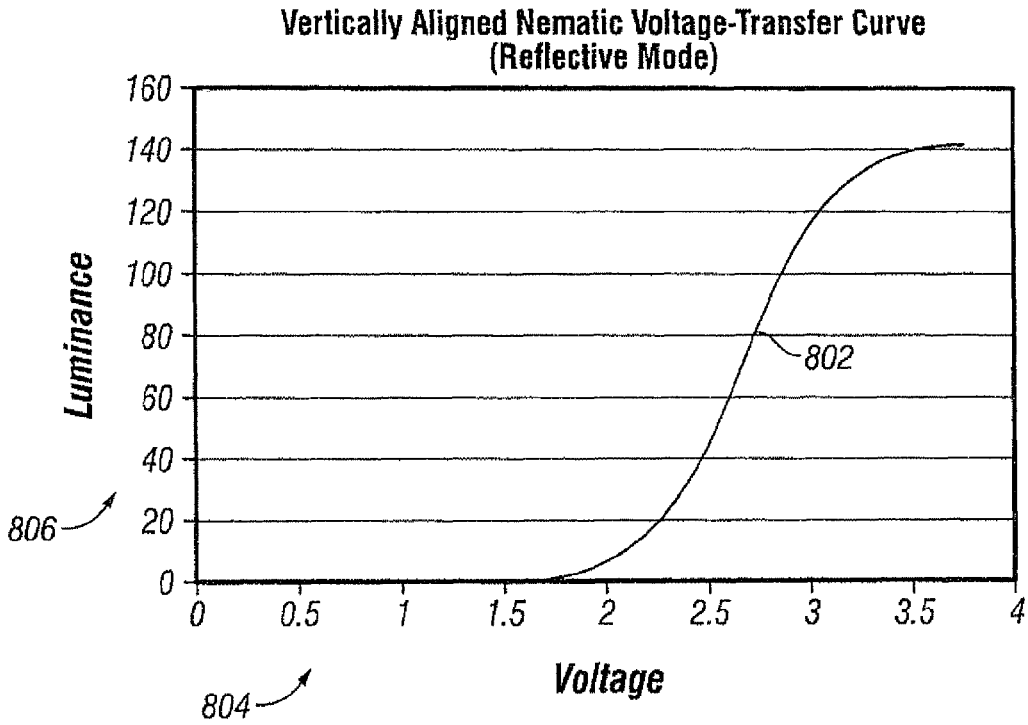
FIG. 8 is a chart illustrating a typical voltage transfer curve for a reflective mode vertically aligned neumatic (VAN) liquid crystal cell.

Voltage-Transfer Curve Transformation into Pulse Width Modulation Transfer Curve FIG. 8 is a chart illustrating a typical voltage transfer curve 802 for a reflective mode vertically aligned neumatic (VAN) liquid crystal cell. In FIG. 8 the horizontal axis 804 is the applied voltage and the vertical axis 806 is the luminance, and therefore limens, of the display. The class of curve illustrated in FIG. 8 is commonly referred to in the art as a voltage-transfer curve. The data shown is quite similar to that of FIG. 7A. Characteristics of the voltage-transfer curve will support detailed analysis of some of the subsequent figures below.

Figure 9A:
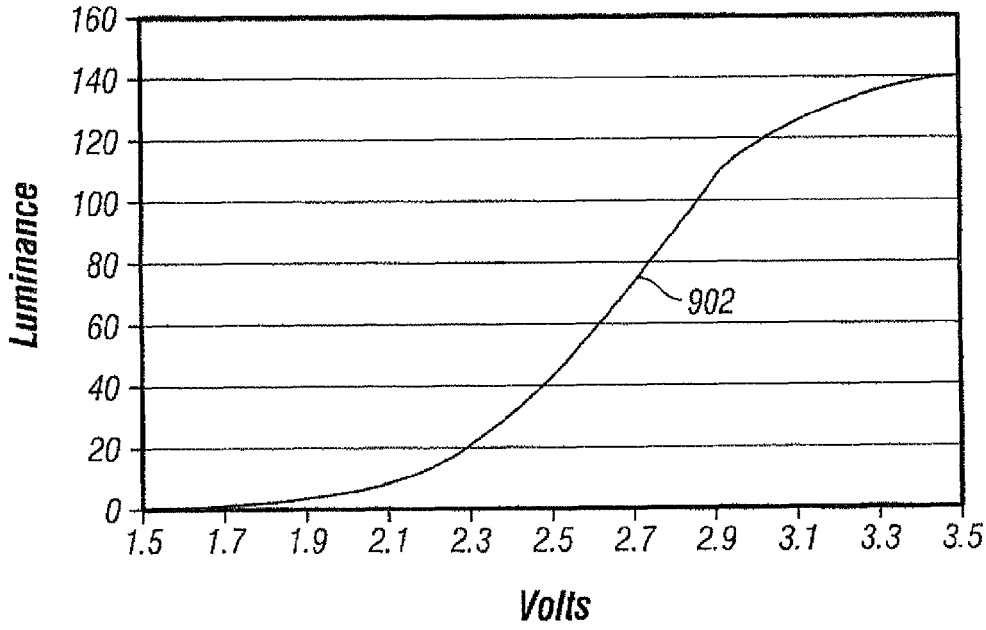
FIG. 9A is a curve illustrating an expanded view of the luminance data of FIG. 8.

FIG. 9A is a curve 902 illustrating an expanded view of the luminance data for the 1.5 volt to 3.5 volt range of FIG. 8. The luminance data in this range is used to illustrate various aspects of VAN liquid crystal cell resulting from various pulse width modulation sequences when the black state voltage is 1.5 volts and the bright state voltage is 3.5 volts. Both voltages are referenced to a common plane of the display device. The two DC balance states are assumed to be symmetrical.

Figures 9B, 9C:
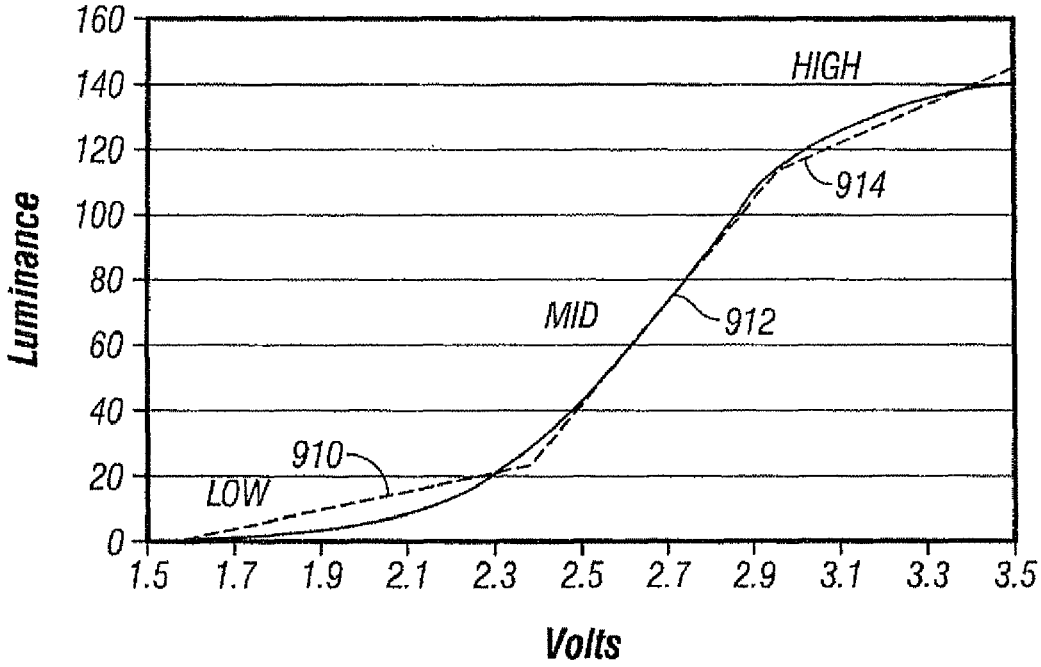
FIG. 9B is a curve illustrating the luminance data from FIG. 9A with three linear estimating segments overlaid.
FIG. 9C is a table that presents approximate slopes of the three linear approximations of FIG. 9B.

FIG. 9B is a curve illustrating the luminance data from FIG. 9A with three linear estimating segments overlaid. In FIG. 9B the linear estimates include a first estimate for the applied voltage range from 1.5 to about 2.4 volts referred to as a low range 910, a second linear estimate for the applied voltage range from about 2.4 to about 3.0 volts, referred to as a middle range 912, and a third linear estimate for the applied voltage from about 3.0 to 3.5 volts referred to as a high range 914 As illustrated in FIG. 9B, the estimating segments of the overlay demonstrate the approximate piecewise linear nature of the voltage transfer curve. In this case, the linear approximations each have a different slope. The approximations will be used to illustrate other aspects as described further below.

FIG. 9C is a table that presents approximate slopes 920 of the three linear approximations 922 of FIG. 9B. In the example of FIG. 9C, the low segment has a slope of 25.64 luminance units per volt and the high segment has a slope of 50.00 luminance units per volt. The low segment and high segment have substantially different slopes, but the slopes are of the same order when compared to the mid segment that has a slope of 173.10 luminance units per volt. Typical digital to analog converters (DAC) have a sufficiently high resolution to apply the appropriate drive voltage needed to create the correct gray level increments.

The situation for pulse width modulated displays is normally quite different. In some display systems each intensity code is directly mapped to a single continuous pulse, but it is more common for the pulse width segments to be created in semi-contiguous or non-contiguous segments to satisfy both the pulse width modulation requirements and to achieve the practical goals of bandwidth efficiency and the like. Each approach taken may generate visual artifacts, as is well known in the art, and the control of those artifacts differentiates the quality of various display implementations.

Figure 10A:
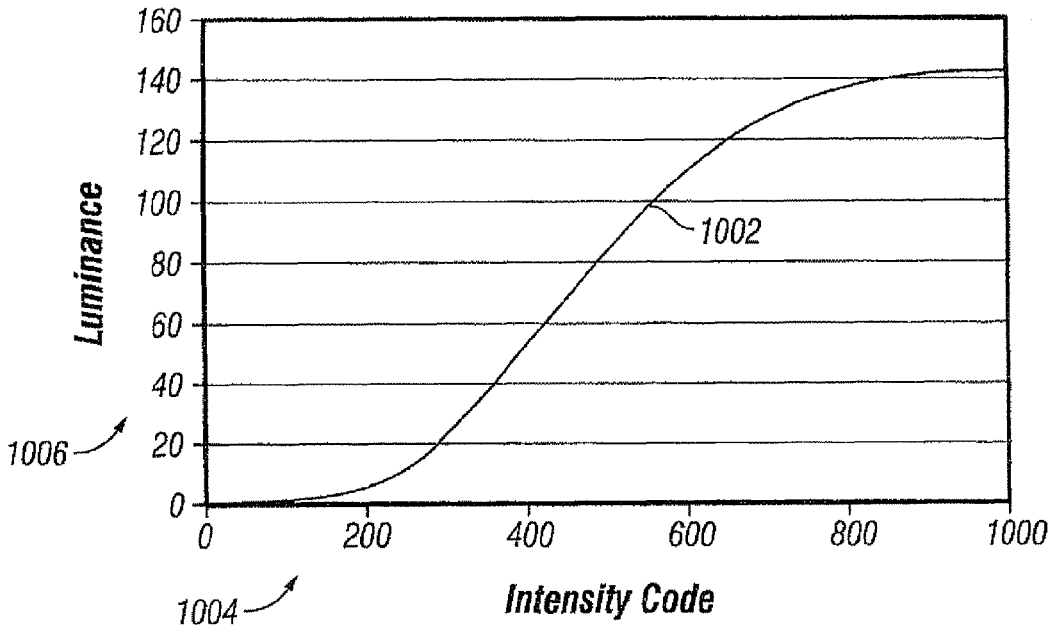
FIG. 10A is a chart illustrating a normalized luminance curve based on intensity code.

FIG. 10A is a chart illustrating a normalized luminance curve 1002 based on intensity code. In FIG. 10A the horizontal axis 1004 represents the intensity code and the vertical axis 1006 represents luminance. An increasing intensity code is intended to represent an increasing pulse width modulation time—not necessarily a linear increase—and therefore a corresponding increase in the luminance obtainable from the device.

Figure 10B:
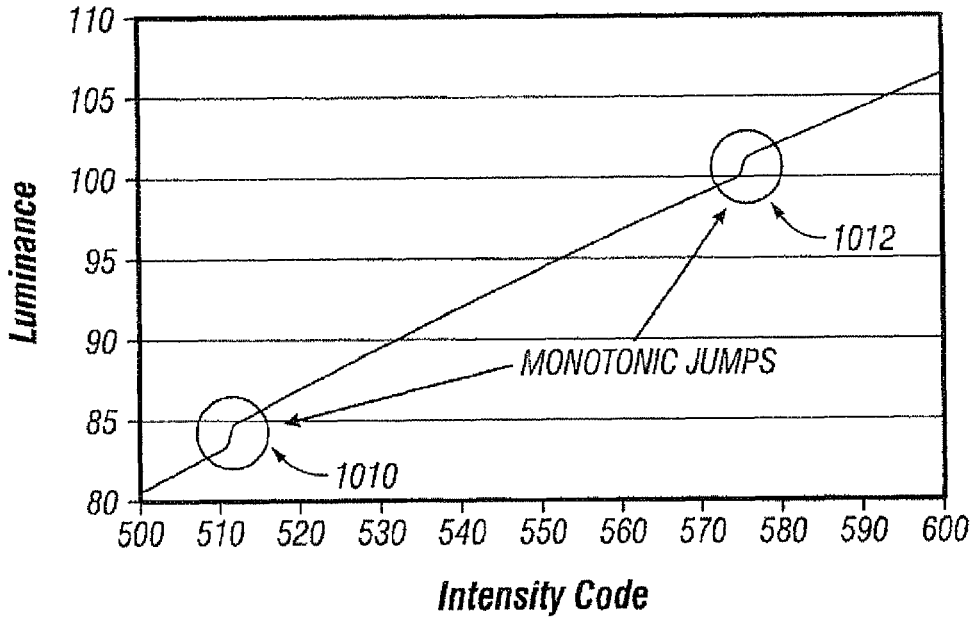
FIG. 10B is a chart illustrating an expanded view of the intensity codes of FIG. 10A.

FIG. 10B is a chart illustrating an expanded view of the intensity codes between 500 and 600 of FIG. 10A. As seen in FIG. 10B, there are two monotonic jumps 1010 and 1012 in the resultant luminance units. These monotonic jumps occur when the pulse width allocation transitions between the higher order bits and the lower order bits as previously mentioned. For example, the first monotonic jump 1010 occurs between intensity code values 511 and 512, and the second monotonic jump 1012 occurs between intensity code values 575 and 576. These monotonic jumps can be problematic because they can result in gray scale discontinuities when the 256 bit image data is mapped into the 1024 intensity data. Such problems are commonly noted but difficult to deal with.

Figures 10C, 10D:
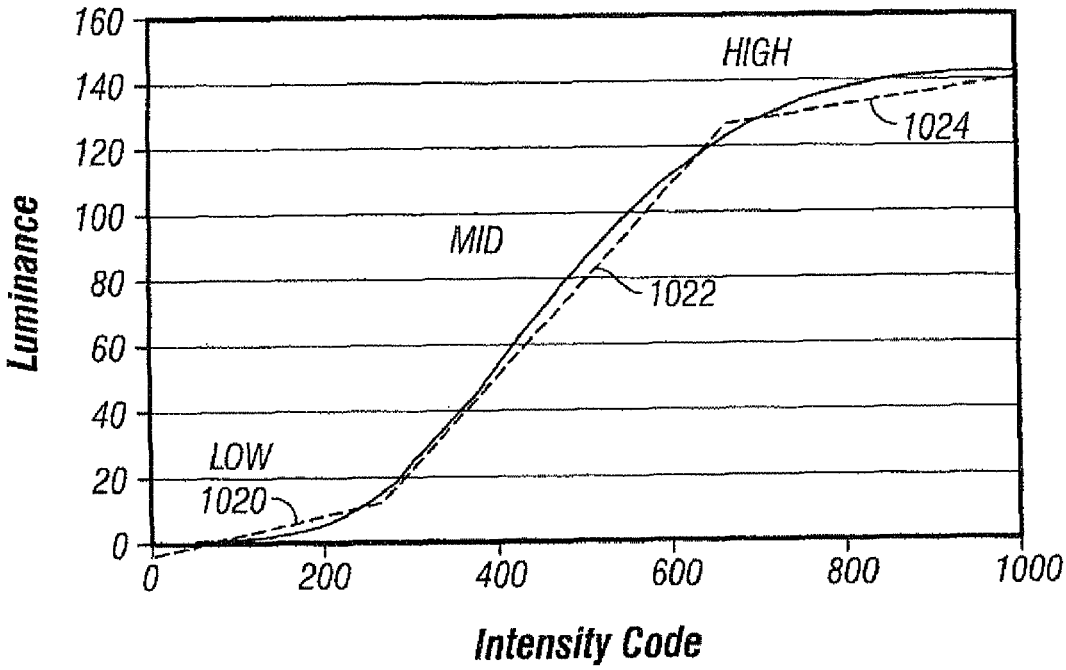
FIG. 10C is a chart showing that data of FIG. 10A with a piecewise linear overlay depicting three linear segments that approximate the slopes of the curve.
FIG. 10D is a table listing the approximate slope information on the piecewise linear approximations depicted in FIG. 10C.

FIG. 10C is a chart showing data of FIG. 10A with a piecewise linear overlay depicting three linear segments 1020, 1022, and 1024 that approximate the slopes of the curve. In FIG. 10C the linear estimates include a first estimate for the applied intensity code range from 0 to about 250 referred to as a low range 1020, a second linear estimate for the applied intensity code range from about 250 to about 650 volts, referred to as a middle range 1022, and a third linear estimate for an applied intensity code range from about 650 to 1000 referred to as a high range 1024.

Inspection of FIG. 10C and comparison to FIG. 9B reveals some similarities in this instance. This reflects, in general, the tendency of a pulse width modulated display to mimic the effects of voltage at an RMS voltage level. It is noted that this is not an absolute measure of agreement but rather a first order agreement.

FIG. 10D is a table listing the approximate slope information 1030 on the piecewise linear approximations 1032 depicted in FIG. 10C. In this instance the high and low segments are quite similar in slope while the slope of the middle segment is quite steep. This is in general a result of the application of some of the techniques previously described in this application.

Figure 11A:
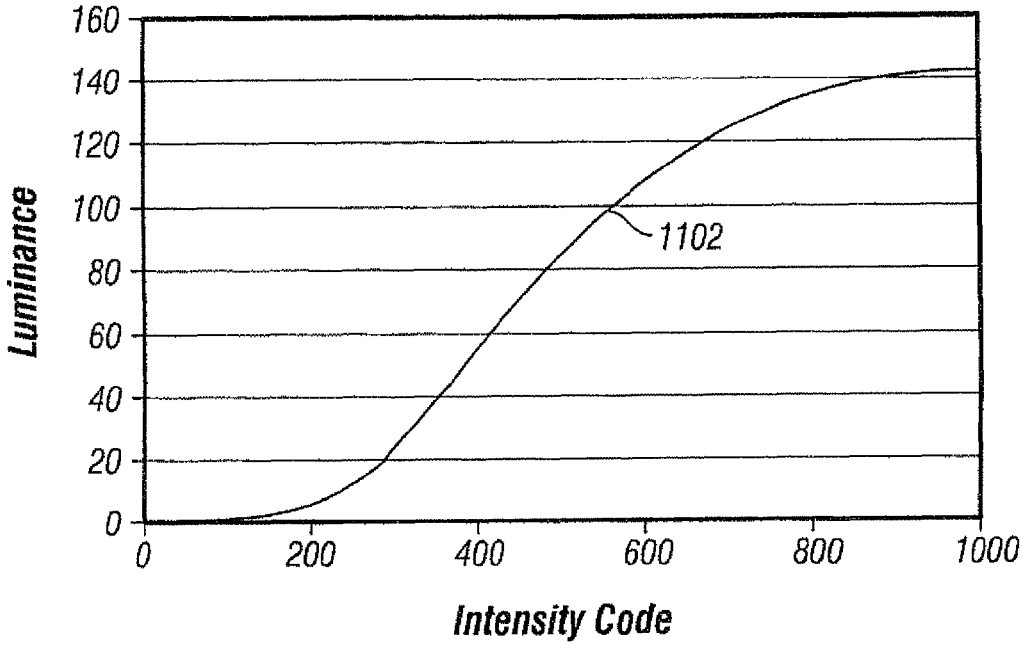
FIG. 11A is a chart depicting a luminance curve on a device similar to the device described in relation to FIGS. 10A-D.

FIG. 11A is a chart depicting a luminance curve 1102 on a device similar to the device described in relation to FIGS. 10A-D. In FIG. 11A a modified gray scale drive sequence, as described herein, is used to drive the device. As shown in FIG. 11A, the curve is similar to FIG. 10A to a first order, but now, as discussed further below, the monotonic jumps become non-monotonic.

Figure 11B:
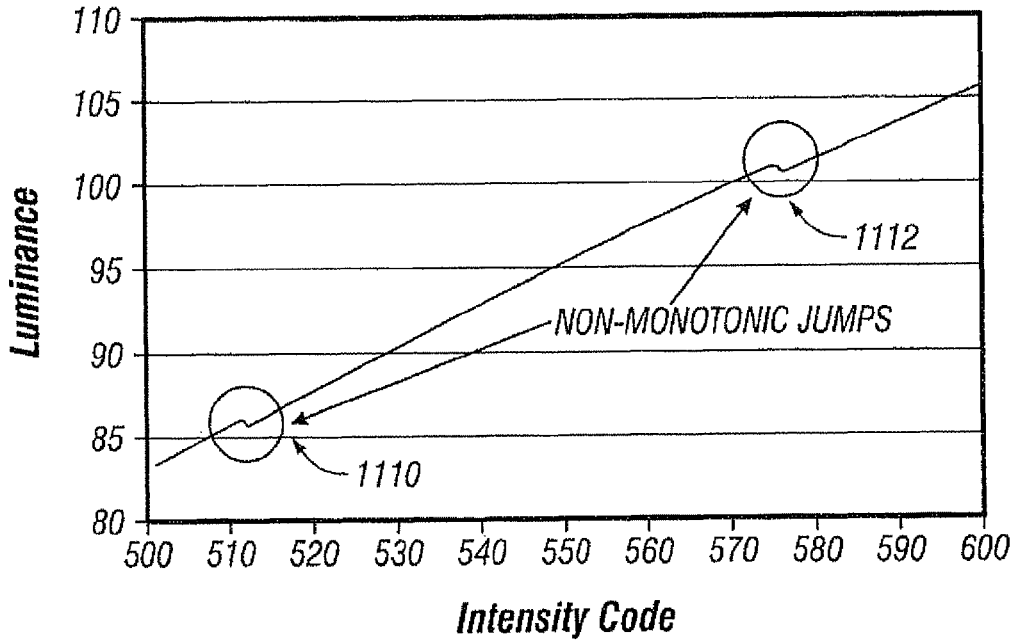
FIG. 11B is a chart showing an expanded view of intensity codes of FIG. 11A.

FIG. 11B is a chart showing an expanded view of intensity codes between 500 and 600 of FIG. 11A. Inspection of FIG. 11B shows that at intensity code values of 511 to 512 and 575 to 576 the jumps have now become non-monotonic 1110 and 1112. The presence of such transitions permits a mapping of the 256 bits of image data into the 1024 intensity codes.

Figure 12A:
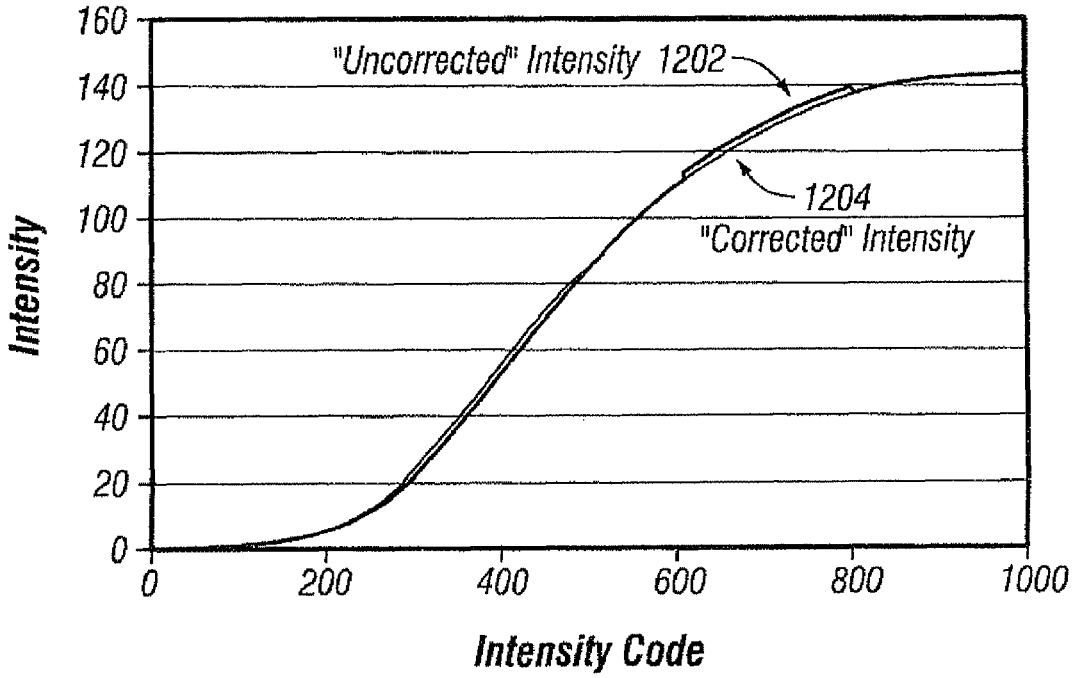
FIG. 12A is a chart that presents a comparison of the data from FIG. 10A to that of FIG. 11A.
Figure 12B:
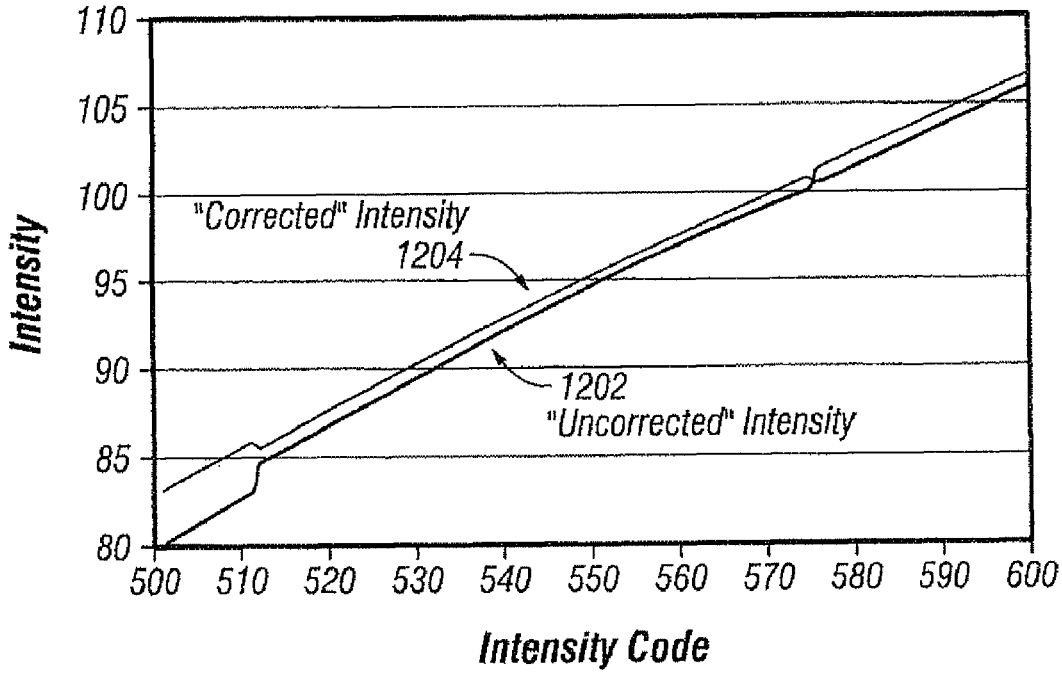
FIG. 12B is a curve showing an expanded view of intensity codes between 500 and 600 of FIG. 12A.

FIG. 12A is a chart that presents a comparison of the data from FIG. 10A (1202) to that of FIG. 11A (1204). As shown in FIG. 12A, it is possible to discern the effects of the monotonic jumps to non-monotonic jumps. FIG. 12B is a curve showing an expanded view of intensity codes between 500 and 600 of FIG. 12A. As shown in FIG. 12B comparing the corrected intensity curve 1204 to the uncorrected intensity curve 1202 shows the switch from monotonic jumps to non-monotonic jumps. FIG. 12B shows that all gray levels are represented at least once and that a mapping from the 256 image data into the 1024 intensity codes could successfully capture any required gray level.

Figure 13A:
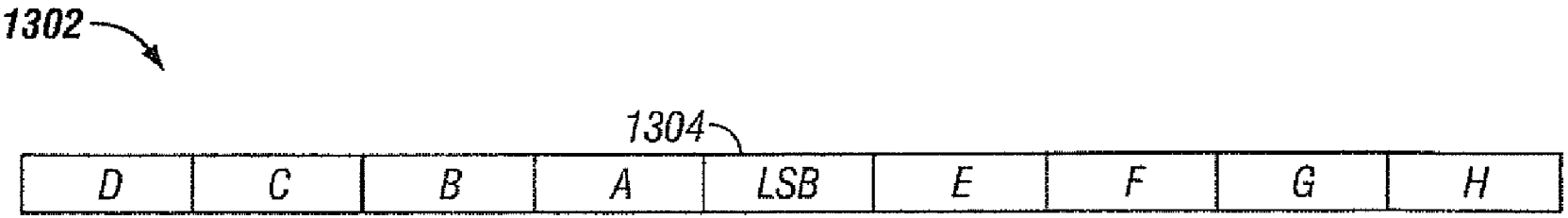
FIG. 13A is a block diagram illustrating an example modulation file sequence 1302 of the type that can be used to generate the files shown in FIGS. 10A.
Figure 13B:
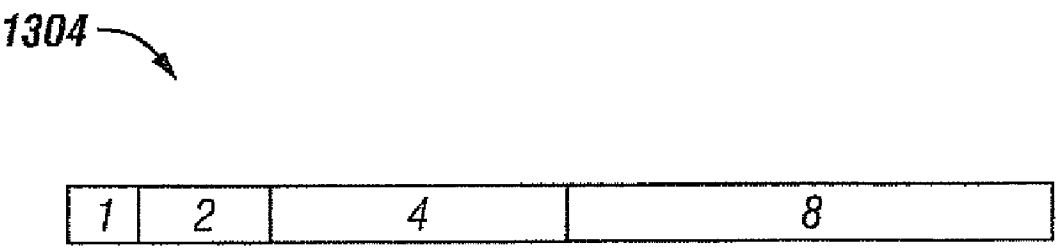
FIG. 13B is a block diagram illustrating further detail of the sequence segment used to generate LSB codes in expanded form.

FIG. 13A is a block diagram illustrating an example modulation drive sequence 1302 of the type that can be used to generate the files shown in FIGS. 10A and 10B. In this case there is one sequence segment 1304 available to generate lower order least significant bits (LSB) codes for the entire gray scale range of the display. FIG. 13B is a block diagram illustrating further detail of the sequence segment 1304 used to generate LSB codes in expanded form. As shown in FIG. 13B, the LSB sequence 1304 is a binary coded sequence that can represent values from 0 to 15.

Figure 14A:
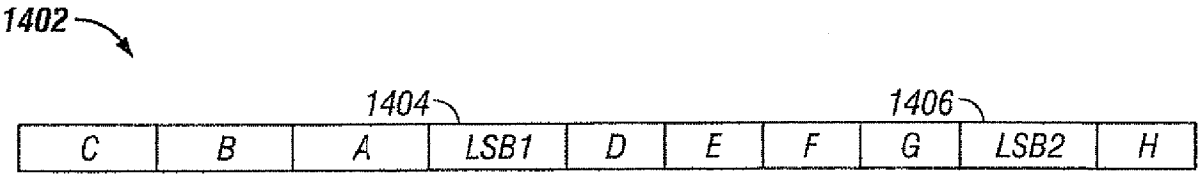
FIG. 14A is a block diagram illustrating an example a gray scale generation sequence in which two different LSB segments and are included.

FIG. 14A is a block diagram illustrating an example a drive sequence 1402 in which two different LSB segments (LSB1) 1404 and (LSB2) 1406 are included. In one embodiment, the first LSB segment (LSB1) 1404 operates, or is used, when the slope of the luminosity curve is shallow, nominally during the low or high segments, while the second LSB segment (LSB2) 1406 is used when the slope of the luminosity curve is steeper.

Figure 14B:
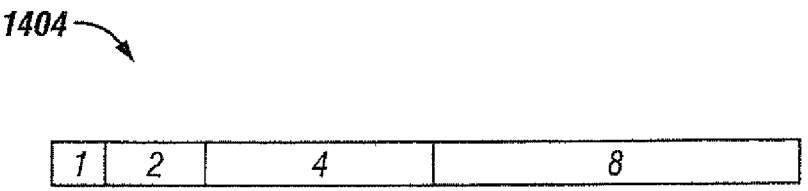
FIGS. 14B is a block diagram illustrating the relative temporal weighting of the first LSB segment.
Figure 14C:
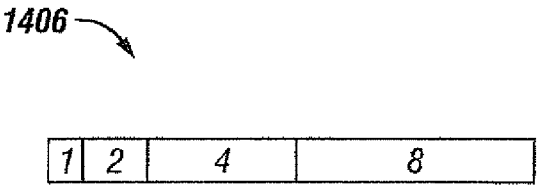
FIG. 14C is a block diagram illustrating the relative temporal weighting of the second LSB segment.

FIG. 14B is a block diagram illustrating the relative temporal weighting of the first LSB segment (LSB1) 1404. FIG. 14C is a block diagram illustrating the relative temporal weighting of the second LSB segment (LSB2) 1406. While the block diagrams of FIGS. 14B and 14C are not to scale, they illustrate that the temporal weighting of the first LSB segment (LSB1) 1404 is longer in duration that the weighting of the second LSB segment (LSB2) 1406. While the example illustrated in FIG. 14A shows two LSB segments interspersed in the sequence 1402, there can be any desired number of LSB segments included within the sequence. In addition, the LSB segments can be placed at any desired location within the sequence.

There are important considerations for the operation of the sequence illustrated in FIG. 14A. One consideration is the operation of one of the LSB segments, such as the first LSB segment (LSB1) 1404 when the other LSB segment, such as the second LSB segment (LSB2) 1406, is in operation.

Operating the first LSB segment (LSB1) 1404 operate while the second LSB segment (LSB2) 1406 is operating may offer several advantages. In this example the first LSB segment (LSB1) 1404 may operate as a major bit sequence element. This may reduce temporal discontinuities in the situation where the first LSB segment (LSB1) 1404 is active in an adjacent pixel. In a second embodiment the first LSB segment (LSB1) 1404 and the second LSB segment (LSB2) 1406 may be operated simultaneously in those instances where more temporal time is needed to create a given gray level adjustment, whereas only the first LSB segment (LSB1) 1404 may be operated when less temporal adjustment is needed.

Figure 15A:
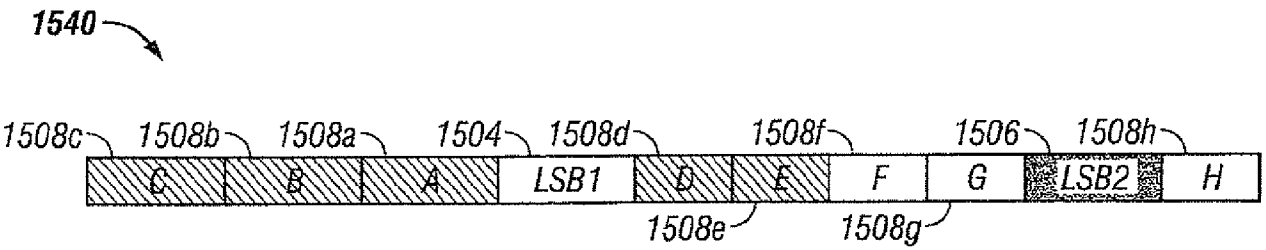
FIG. 15A is a block diagram illustrating a first embodiment of a drive sequence that includes two LSB segments.

FIG. 15A is a block diagram illustrating a first embodiment of a drive sequence 1502 that includes two LSB segments 1504 and 1506. In the example illustrated in FIG. 15A temporal segments 1508*a-e* are active and temporal segments 1508*f-h* are not active. In this embodiment, the first LSB segment (LSB1) 1504 is turned off, or inactive, once the second LSB segment (LSB) 1506 operates.

Figure 15B:
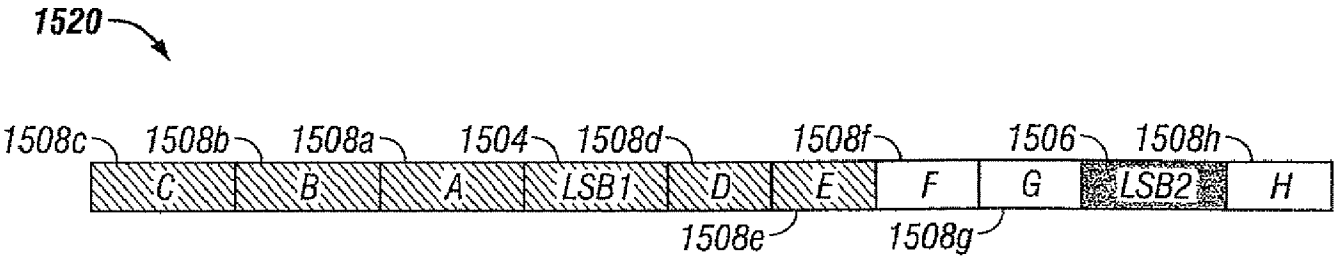
FIG. 15B is a block diagram illustrating another embodiment of a drive sequence 1520 that includes two LSB segments.

FIG. 15B is a block diagram illustrating another embodiment of a drive sequence 1520 that includes two LSB segments (LSB1) 1504 and (LSB2) 1506. In the example illustrated in FIG. 15B temporal segments 1508*a-e* are active and temporal segments 1508*f-h* are not active. In this embodiment, the first LSB segment (LSB1) 1504 is left on, or active, when the second LSB segment (LSB2) 1506 operates. In other words, when the second LSB segment (LSB2) 1506 is operating all lesser bits within the first LSB segment (LSB1) 1504 are active, or turned on. In this embodiment, the first LSB segment (LSB1) 1504 is handled as a higher order bit sequence once the second LSB segment (LSB2) 1506 is active. The embodiment illustrated in FIG. 15B reduces the temporal displacement between nearly identical gray levels.

It has been demonstrated that the embodiment illustrated in FIG. 15B is effective in reducing the appearance of motion contouring, especially that associated with dynamic false contouring, at the transition point between the first and second LSB segments 1504 and 1506. Dynamic false contours are typically especially visible at mid gray level.

Figure 15C:
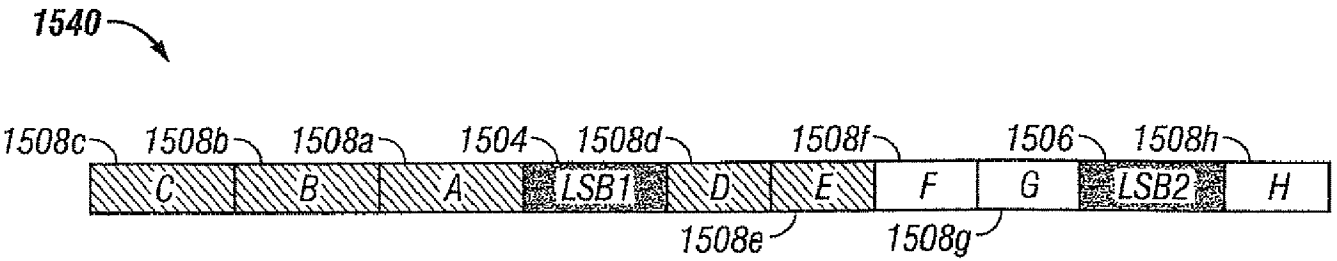
FIG. 15C is a block diagram of still another embodiment of a drive sequence 1540 that includes two LSB segments.

FIG. 15C is a block diagram of still another embodiment of a drive sequence 1540 that includes two LSB segments (LSB1) 1504 and (LSB2) 1506. In the example illustrated in FIG. 15C temporal segments 1508*a-e* are active and temporal segments 1508*f-h* are not active. In this embodiment both LSB segments (LSB1) 1504 and (LSB2) 1506 remain active simultaneously. In one embodiment it is possible that both LSB segments may apply only in a given range, or ranges, of intensity codes and that during other intensity codes one of the other conditions, for example the embodiments illustrated in FIGS. 15A and 15B, may apply. In other words, a system can alternate between the embodiments described in FIGS. 15A-C at different ranges of intensity codes.

Figure 16B:
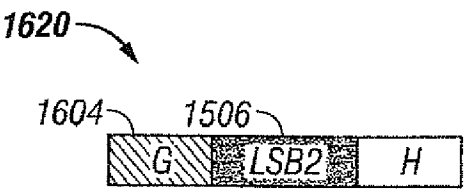
FIG. 16B is a block diagram of another embodiment illustrating a portion of a drive sequence 1610 that includes a second LSB segment such as illustrated in FIG. 15A or 15B.
Figure 16A:
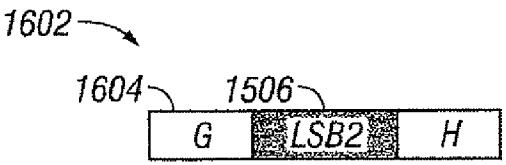
FIG. 16A is a block diagram illustrating a portion of a drive sequence that includes a second LSB segment such as illustrated in FIG. 15A or 15B.
Figure 16A:
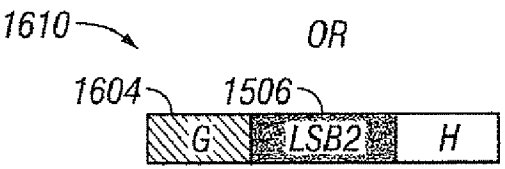

FIG. 16A is a block diagram illustrating a portion of a drive sequence 1602 that includes a second LSB segment (LSB2) 1506 such as illustrated in FIG. 15A or 15B. As shown in FIG. 16A, the higher order bit 1604 before the LSB segment 1506 does not need not be active when the LSB segment 1506 is operating. Likewise, a portion of a drive sequence 1610 illustrates that the higher order bit 1604 before the LSB segment 1506 can be active as the LSB segment 1506 operates.

FIG. 16B is a block diagram of another embodiment illustrating a portion of a drive sequence 1610 that includes a second LSB segment (LSB2) 1506 such as illustrated in FIG. 15A or 15B. In the embodiment FIG. 16B a boundary condition is illustrated where the higher order bit 1604 before LSB segment 1506 is active before the LSB segment 1506 is active.

Figure 17A:
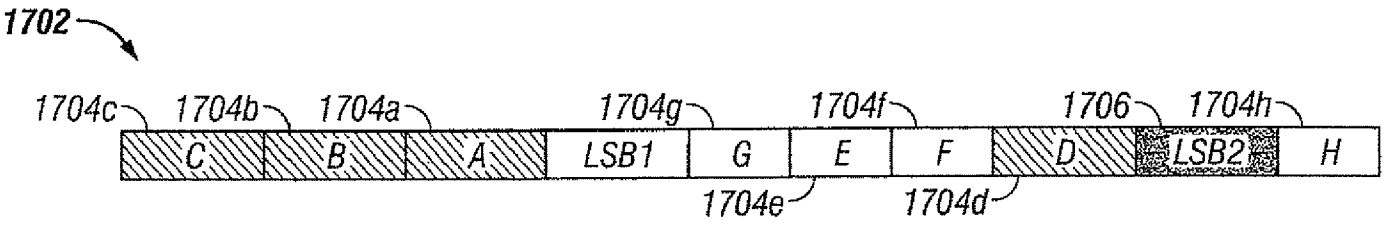
FIG. 17A is a block diagram of an embodiment of a drive sequence.
Figure 17B:
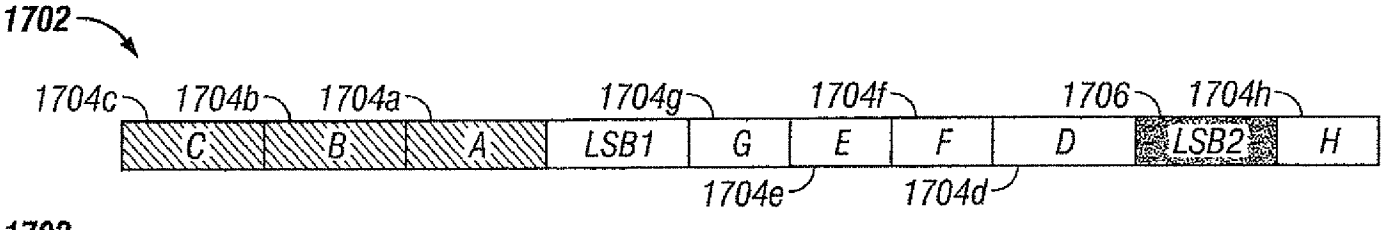
FIG. 17B is another example embodiment of a drive sequence.
Figure 17B:
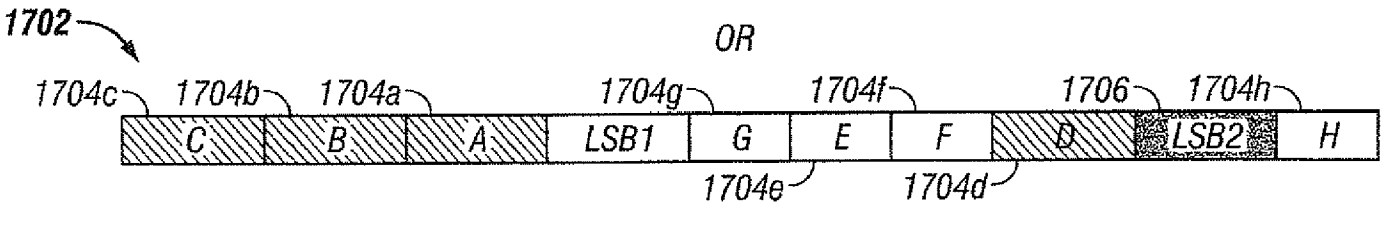

FIG. 17A is a block diagram of another embodiment of a drive sequence 1702. The embodiment illustrated in FIG. 17A illustrates further detail of a first sequence condition after a sequence as illustrated in FIG. 15A in which a boundary condition (or lack thereof) of FIG. 16A is observed. In this embodiment, the higher order bit 1704*d* temporally preceding the second LSB segment (LSB2) 1706 is on. FIG. 17B is another example embodiment of a drive sequence 1702. In the example of FIG. 17B a second sequence condition after FIG. 15A in which the boundary condition of FIG. 16A is satisfied. Specifically the higher order bit 1704 temporally preceding the second LSB segment (LSB2) 1706 may be on. Also shown in FIG. 17B is an example where the higher order bit 1704 temporally preceding the second LSB segment (LSB2) 1706 may be off.

Figure 17C:
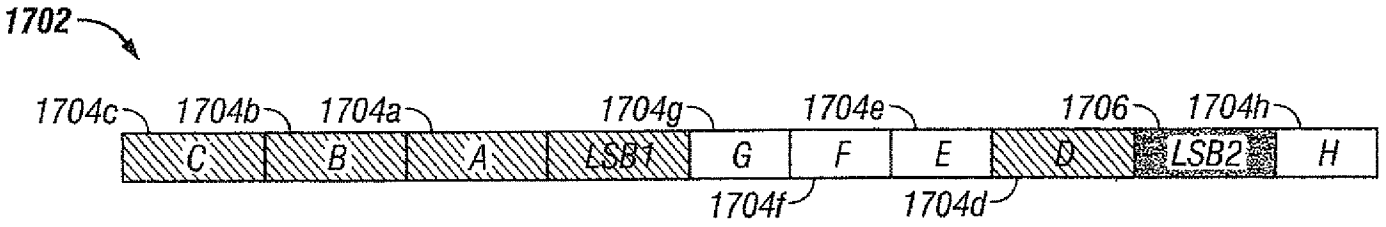
FIG. 17C is a block diagram of another embodiment of a drive sequence.

FIG. 17C is a block diagram of another embodiment of a drive sequence 1702. In the embodiment illustrated in FIG. 17C a third sequence condition after FIG. 15B in which the boundary condition (or lack thereof) of FIG. 16A is observed, that being that the higher order bit 1704*d* temporally preceding the second LSB segment (LSB2) 1706 is on. FIG. 17D is a block diagram of still another embodiment of a drive sequence 1702. In the example embodiment of FIG. 17D a fourth sequence condition after FIG. 15B in which the boundary condition of FIG. 16A is satisfied. Specifically the higher order bit 1704*d* temporally preceding the second LSB segment (LSB2) 1706 is on. Also shown in FIG. 17D is an example where the higher order bit 1704*d* preceding the second LSB segment (LSBs) 1706 temporally is off.

FIG. 18A is a block diagram illustrating an embodiment of an LSB segment 1802. In the embodiment illustrated in FIG. 18A the LSB segment 1702 includes lesser segments 1804, 1806, 1808, and 1810. It is noted that the temporal order of the lesser segments can be adjusted within the scope of the invention. It is also noted that the number of lesser bits illustrated in the examples described herein are not limited to the number of lesser bits depicted but can include more or less number of lesser bits than shown in the examples presented.

FIG. 18B is a block diagram illustrating an alternative variation between the nature of the first and second LSB segments (LSB1 and LSB2), such as the LSB segments illustrated in FIGS. 14-17. In the example illustrated in FIG. 18B not all lesser segments are represented in second LSB segment 1802 which only includes one lesser segment 1810. The embodiment illustrated in FIG. 18B may be less effective than the example of FIGS. 14B and 14C but nevertheless provides some benefit. In one embodiment, the lesser bits of the first LSB segment (LSB1) not represented in the second LSB segment (LSB2) remain active.

FIG. 18C is a block diagram illustrating another alternative variation between the nature of the first and second LSB segments (LSB1 and LSB2). In the example illustrated in FIG. 18C two lesser segments 1808 and 1810 are represented. The order of the two lesser segments 1808 and 1810 may be varied. In addition, the first and second LSB segments (LSB1 and LSB2) may have different orderings. FIG. 18D is a block diagram illustrating still another alternative variation between the nature of the first and second LSB segments (LSB1 and LSB2). As illustrated in the example of three lesser segments 1802, 1808, and 1810 are included in the second LSC segment (LSB2). Again, the order of the three lesser segments 1806, 1808 and 1810 may be varied. In addition, the first and second LSB segments (LSB1 and LSB2) may have different orderings.

Figure 19A:
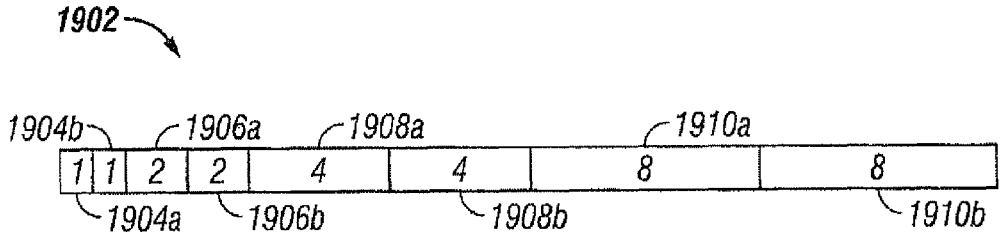
FIG. 19A is a block diagram of an embodiment of an LSB segment.

FIG. 19A is a block diagram of an embodiment of an LSB segment 1902. FIG. 19A illustrates a technique for switching between an LSB sequence with more temporal authority to an LSB sequence with less. As illustrated in FIG. 19A, the LSB segment 1902 includes redundant lesser segments. For example, in FIG. 19A there are two instances of each of the lesser segments 1904*a-b*, 1906*a-b*, 1908*a-b*, and 1910*a-b* respectively. This embodiment provides improved gray scale accuracy. The close proximity of each lesser bit to its pair may make the control of rise and fall times problematic.

Figure 19B:
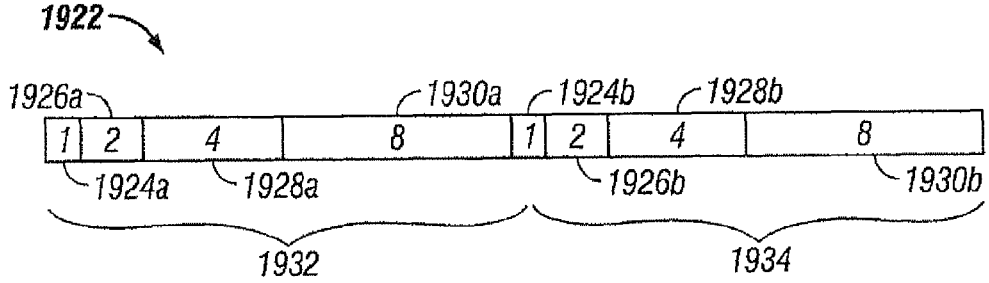
FIG. 19B is a block diagram of another embodiment of an LSB segment.

FIG. 19B is a block diagram of another embodiment of an LSB segment 1922. FIG. 19B illustrates another technique for switching between an LSB sequence with more temporal authority to one with less. As illustrated in FIG. 19B, the LSB segment 1922 includes redundant lesser segments. For example, in FIG. 19B there are two instances of each of the lesser segments 1924*a-b*, 1926*a-b*, 1928*a-b*, and 1930*a-b* respectively. The lesser segments are grouped into two blocks 1932 an d 1934, with the first instance of each pair, 1924*a*, 1926*a*, 1928*a*, and 1930*a* in the first block 1932 and the second instance of each pair, 1924*b*, 1926*b*, 1928*b*, and 1930*b* in the second block 1934. Again, this embodiment provides additional benefit of gray scale accuracy. In the embodiments illustrated in FIGS. 19A and 19B, different arrangements and orders of the lesser segments can be used.

Figure 20:
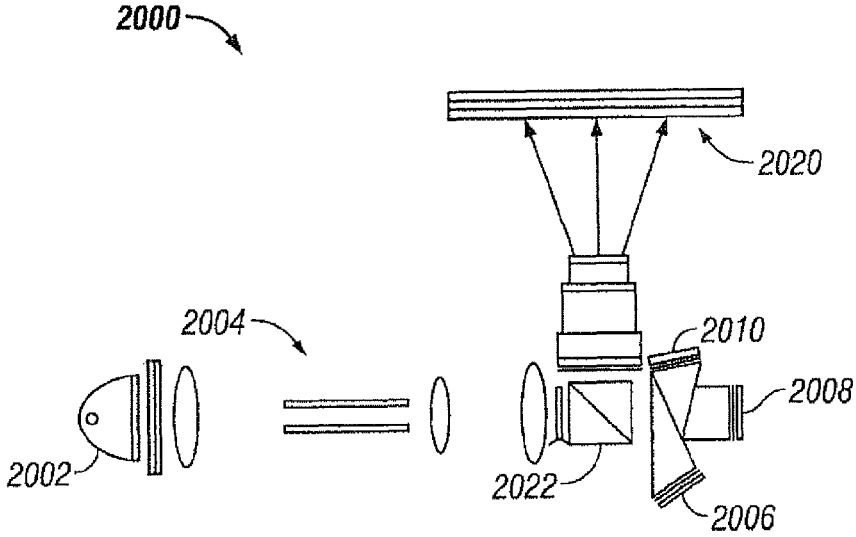
FIG. 20 is a block diagram of a display system that can use aspects od improved gray scale drive sequences disclosed herein.

FIG. 20 is a schematic diagram of a display system that can use aspects of the improved modulation techniques as disclosed herein. The display system 2000 using improved modulation techniques described herein may be used for projecting an image. A white light source 2002 and optics 2004 may be used to direct light toward a polarizing beam splitter/Philips prism combination 2022 that separates the white light into red, green, and blue components. The red, green, and blue components are directed towards displays 2010, 2008, and 2006. A controller, not shown, can generate drive sequences, as described above, to drive the displays 2006, 2008, and 2010 so that each display creates a gray scale image of one color which is then combined through the polarizing beam splitter/Philips prism combination 2022 and projected through a projection lens to form the image 2020. The displays according to the present invention may also be used in other multi-display devices as known in the art.

Figure 21:
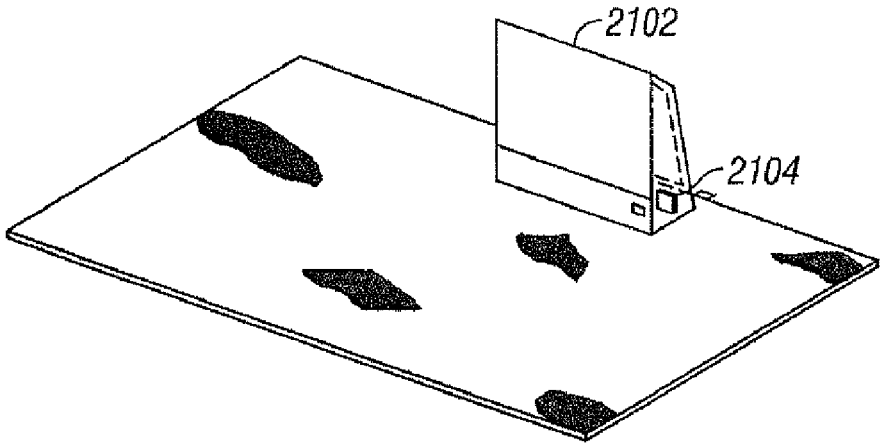
FIG. 21 is a block diagram of an embodiment of a television or monitor incorporating a display that includes a controller that generates drive sequences as described herein, for example, drive sequences as described in FIGS. 2-6 and 8-19.
Figure 22:
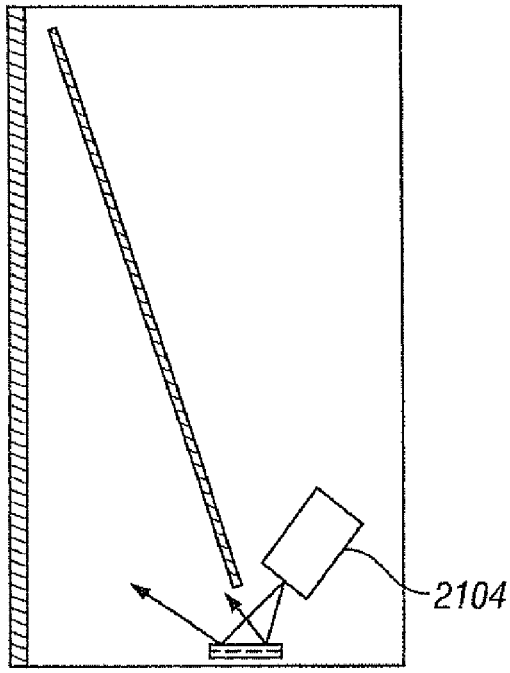
FIG. 22 is a block diagram of another embodiment of the television or monitor 2102 as a rear projection device.
Figure 23:
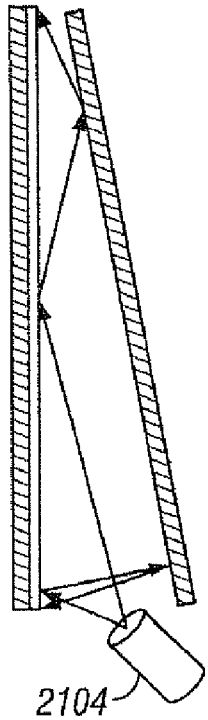
FIG. 23 is a block diagram of another embodiment of the television or monitor 2102 as a rear projection device.

Drive sequences as described herein can be used in various display systems. FIG. 21 is a block diagram of an embodiment of a television or monitor 2102 incorporating a display 2104 that includes a controller that generates drive sequences as described herein, for example, drive sequences as described in FIGS. 2-6 and 8-19. The drive sequences are used to generate gray scale used in generating the image displayed. FIG. 21 is a block diagram illustrating an embodiment of the television or monitor 2102 as a rear projection device. FIG. 22 is a block diagram of another embodiment of the television or monitor 2102 as a rear projection device. FIG. 23 is a block diagram of another embodiment of the television or monitor 2102 as a rear projection device. Various configurations may be used to project a larger image from display device 2104. For example, a front projection device (not shown) similar to that shown in FIG. 20, may also be used to create a larger image from a display device 2104.

Figure 24:
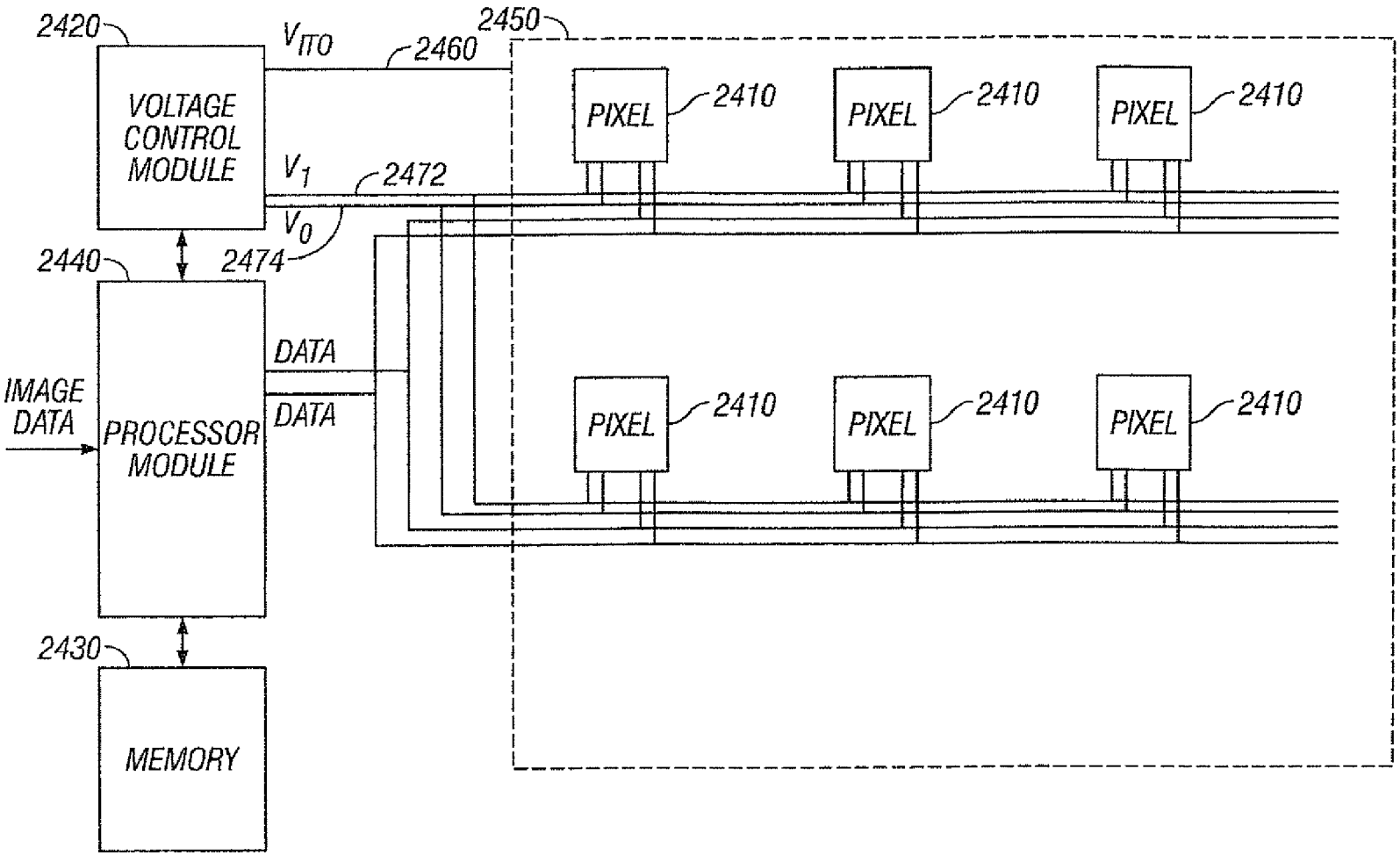
FIG. 24 is a block diagram of one embodiment of a display system.

FIG. 24 is a block diagram of one embodiment of a display system 2400. The display system 2400 includes an array of pixel cells 2410, a voltage control module 2420, a processing module 2440, a memory module 2430, and a transparent common electrode 2450. The common transparent electrode overlays the entire array of pixel cells 2410. In one embodiment, pixel cells 2410 are formed on a silicon substrate or base material, and are overlaid with an array of pixel mirrors and each single pixel mirror corresponding to each of the pixel cells 2410. A substantially uniform layer of liquid crystal material is located in between the array of pixel mirrors and the transparent common electrode 2450. In another embodiment, the transparent common electrode 2450 is a conductive glass material such as Indium Tin-Oxide (ITO). In another embodiment, the transparent electrode 2450 is coated onto a glass material. Both the glass side and the silicon side are coated with an alignment layer, for example, SiO2 or other material.

In one embodiment, the processor module 2440 receives data from an image source. The source data may be in various formats such as digital video interface (DVI), or high definition multimedia interface (HDMI), or other format. The source data can also represent a single color, or multiple colors within an image. The processor module 2440 is in communication with a voltage control module 2420 and a memory module 230.

The memory module 2430 is a computer readable medium including programmed data and commands. The memory module can also buffer source data or processed data from the processor module 2440. In one embodiment, the memory module 2430 may store data and the processor module 2440 may also include registers to store data.

The voltage control module supplies the bias voltage Vito 1260 to the common transparent electrode 2450. The voltage control module 2420 also supplies the voltages V0 and V1 (2472 and 2474) that are used to drive the pixels 2410. As is well know in the art, Vito may be a single preset voltage or it may be two or more time sequenced alternating voltages, depending on the precise display architecture used.

The processing module 2440 can produce modulation schemes for controlling the gray scale of the pixels cells 2410. In one embodiment, the processing module 2440 generates drive sequences, such as the drive sequences describe in relation to FIGS. 2-6 and 8-19, and provides data 2480 and compliment of the data 2482 to the pixels 2410 to select the voltage level that is applied to the pixel in accordance with the drive sequence. In one embodiment, a separate signal is sent by the processing module 1240 to a voltage selection circuit to set the state of a DC balance control element that can either pass the data signal state as is or else invert it. Alternatively, the supply voltages V0 and V1 may be alternated to create a similar effect at the pixel.

In one embodiment, the functions of the processing module 2440, memory 2430 and voltage control module 2420 are performed in a single module or device. In other embodiments, the functions are distributed across multiple modules or devices.

Various embodiments may also be implemented primarily in hardware using, for example, components such as application specific integrated circuits ("ASICs"), or field programmable gate arrays ("FPGAs"). Implementation of a hardware state machine capable of performing the functions described herein will also be apparent to those skilled in the relevant art. Various embodiments may also be implemented using a combination of both hardware and software.

The term "module" as used herein means, but is not limited to a software or hardware component, such as an FPGA or an ASIC, which performs certain tasks. A module may advantageously be configured to reside on an addressable storage medium and configured to execute on one or more network enabled devices or processors. Thus, a module may include, by way of example, components, processes, functions, attributes, procedures, subroutines, segments of program code, drivers, firmware, microcode, circuitry, data, databases, data structures, tables, arrays, variables, and the like. The functionality provided for in the components and modules may be combined into fewer components and modules or further separated into additional components and modules. Additionally, the components and modules may advantageously be implemented to execute on one or more network enabled devices or computers.

Furthermore, those of skill in the art will appreciate that the various illustrative logical blocks, modules, circuits, and method steps described in connection with the above described figures and the embodiments disclosed herein can often be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled persons can implement the described functionality in varying ways for each particular application, but such implementation decisions should not be interpreted as causing a departure from the scope of the invention. In addition, the grouping of functions within a module, block, circuit or step is for ease of description. Specific functions or steps can be moved from one module, block or circuit to another without departing from the invention.

Moreover, the various illustrative logical blocks, modules, and methods described in connection with the embodiments disclosed herein can be implemented or performed with a general purpose processor, a digital signal processor ("DSP"), an ASIC, FPGA or other programmable logic device, discrete gate or transistor logic, discrete hardware components, or any combination thereof designed to perform the functions described herein. A general-purpose processor can be a microprocessor, but in the alternative, the processor can be any processor, controller, microcontroller, or state machine. A processor can also be implemented as a combination of computing devices, for example, a combination of a DSP and a microprocessor, a plurality of microprocessors, one or more microprocessors in conjunction with a DSP core, or any other such configuration.

Additionally, the steps of a method or algorithm described in connection with the embodiments disclosed herein can be embodied directly in hardware, in a software module executed by a processor, or in a combination of the two. A software module can reside in RAM memory, flash memory, ROM memory, EPROM memory, EEPROM memory, registers, hard disk, a removable disk, a CD-ROM, or any other form of storage medium including a network storage medium. An exemplary storage medium can be coupled to the processor such the processor can read information from, and write information to, the storage medium. In the alternative, the storage medium can be integral to the processor. The processor and the storage medium can also reside in an ASIC.

While the above is a complete description of the preferred embodiment of the present invention, it is possible to use various alternatives, modifications and equivalents. Therefore, the scope of the present invention should be determined not with reference to the above description but should, instead, be determined with reference to the appended claims, along with their full scope of equivalents. Any feature described herein, whether preferred or not, may be combined with any other feature described herein, whether preferred or not. Thus, the invention is not intended to be limited to the embodiment shown herein but is to be accorded the widest scope consistent with the principal and novel features disclosed herein.

What is claimed is:

1. A projection display system comprising:

an illumination source with optics to direct that illumination to a liquid crystal display component;

projection optics to direct light from a liquid crystal display component to a display screen; and a liquid crystal display component system comprising a liquid crystal display component and display controller;

wherein the display component is modulated by data from the display controller;

wherein the data comprises a pulse set of non-binary, non-equal, weighted temporal segments based on the image data, assembled into a sequence;

wherein selected segments are activated in accordance with a desired brightness level of pixels within the display; and wherein the sequence includes at least two least significant bit segments.

2. The system of claim 1, wherein the at least two least significant bit segments are not adjacent to each other.

3. The system of claim 1, wherein the temporal activation of the segments is discontinuous.

4. The system of claim 1, wherein the sequence comprises non-contiguous time slots.

5. The system of claim 1, wherein the display component comprises liquid crystal on silicon elements.

6. The system of claim 1, wherein the image data comprises a gray scale command.

7. The system of claim 1, wherein the image data comprises multiple color of image data.

8. The system of claim 1, wherein the at least two least significant bit segments comprise a first least significant bit sequence and a second least significant bit sequence.

9. The system of claim 8, wherein the first least significant bit sequence is of substantially identical temporal weighting to the second least significant bit sequence.

10. The system of claim 8, wherein the first least significant bit sequence differs in temporal weighting from the second least significant bit sequence.

* * * * *